United States Patent [19]

Criscimagna et al.

[11] Patent Number: 4,591,847

[45] Date of Patent: May 27, 1986

[54] METHOD AND APPARATUS FOR GAS DISPLAY PANEL

[75] Inventors: Tony N. Criscimagna, Woodstock; Albert O. Piston, Catskill, both of N.Y.

[73] Assignee: International Business Machines Corporation, Armonk, N.Y.

[21] Appl. No.: 372,384

[22] Filed: Jun. 21, 1973

Related U.S. Application Data

[63] Continuation of Ser. No. 268,219, Jun. 23, 1972, abandoned, which is a continuation of Ser. No. 885,086, Dec. 15, 1969, abandoned.

[51] Int. Cl.[4] ..... G09F 9/00

[52] U.S. Cl. ..... 340/776; 315/169.4; 340/778; 340/805

[58] Field of Search ..... 340/324 M, 776, 805

[56] References Cited

U.S. PATENT DOCUMENTS

| | | | |
|---|---|---|---|
| 2,354,800 | 8/1944 | Deal . | |
| 2,495,317 | 1/1950 | Dorbec . | |
| 3,526,711 | 9/1970 | Boer | 340/166 EL |
| 3,573,542 | 4/1971 | Mayer et al. | 340/805 X |
| 3,588,597 | 6/1971 | Murley | 315/169 R |
| 3,601,532 | 8/1971 | Bitzer et al. | 178/7.3 D |
| 3,609,746 | 9/1971 | Trogdon | 340/324 M |
| 3,611,019 | 10/1971 | Krembs | 313/220 X |
| 3,614,739 | 10/1971 | Johnson | 340/166 EL |
| 3,614,769 | 10/1971 | Coleman et al. | 340/324 M |
| 3,618,071 | 11/1971 | Johnson et al. | 340/324 M |
| 3,671,938 | 6/1972 | Ngo | 340/166 EL |
| 4,101,810 | 7/1978 | Schermerhorn et al. | 340/779 |

*Primary Examiner*—David L. Trafton
*Attorney, Agent, or Firm*—Joseph J. Connerton

[57] ABSTRACT

Low cost apparatus for a gas display panel is operated by a method to provide reliable write, sustain, and erase operations. For sustain operations a first square wave train is applied to all horizontal lines of the gas display panel simultaneously as a second square wave train, displaced 90° from the first square wave train is applied to all vertical lines. For a write operation the frequency of the first and second square wave trains is reduced, and a pulse is superimposed or algebraically added to the sustain signals which results in a composite signal. The superimposed signal (a) increases the potential on a selected horizontal line, (b) decreases the potential on the remaining horizontal lines, (c) decreases the potential on a selected vertical line, and (d) inceases the potential on the remaining vertical lines. The selected cell receives an increased potential difference sufficient to equal or exceed the ignition potential after all of the remaining cells receive a sustain potential which ignites all cells which were previously ignited. The algebraically added pulses cancel out the effect of each other across the half selected cells and the non selected cells. For an erase operation a given signal of constant magnitude and polarity is applied to all horizontal lines and all vertical lines, and a pulse is algebraically added on the given signal which (a) increases the potential on a selected horizontal line, (b) decreases the potential on the non selected horizontal lines, (c) decreases the potential on a selected vertical line, and (d) increases the potential on the non selected vertical lines whereby no gas cell in the gas panel receives a potential difference sufficient to equal or exceed the sustain level. However, the selected gas cell, and only this gas cell, receives a potential difference having a polarity opposite to that of the last sustain signal and an amplitude that is just barely sufficient to fire the cell, and this is effective in reducing the charge sometimes referred to as the wall charge, across the selected gas cell substantially to zero. After a suitable time delay, referred to as dead time, the wall charge across the selected gas cell is reduced to zero, and the selected gas cell thus is returned to the extinguished state. A sustain operation then takes place which reignites all gas cells previously ignited before the erase operation except the selected erased cell. The algebraically added pulses cancel out the effect of each other across the half selected cells and the non selected cells.

82 Claims, 7 Drawing Figures

FIG. 1
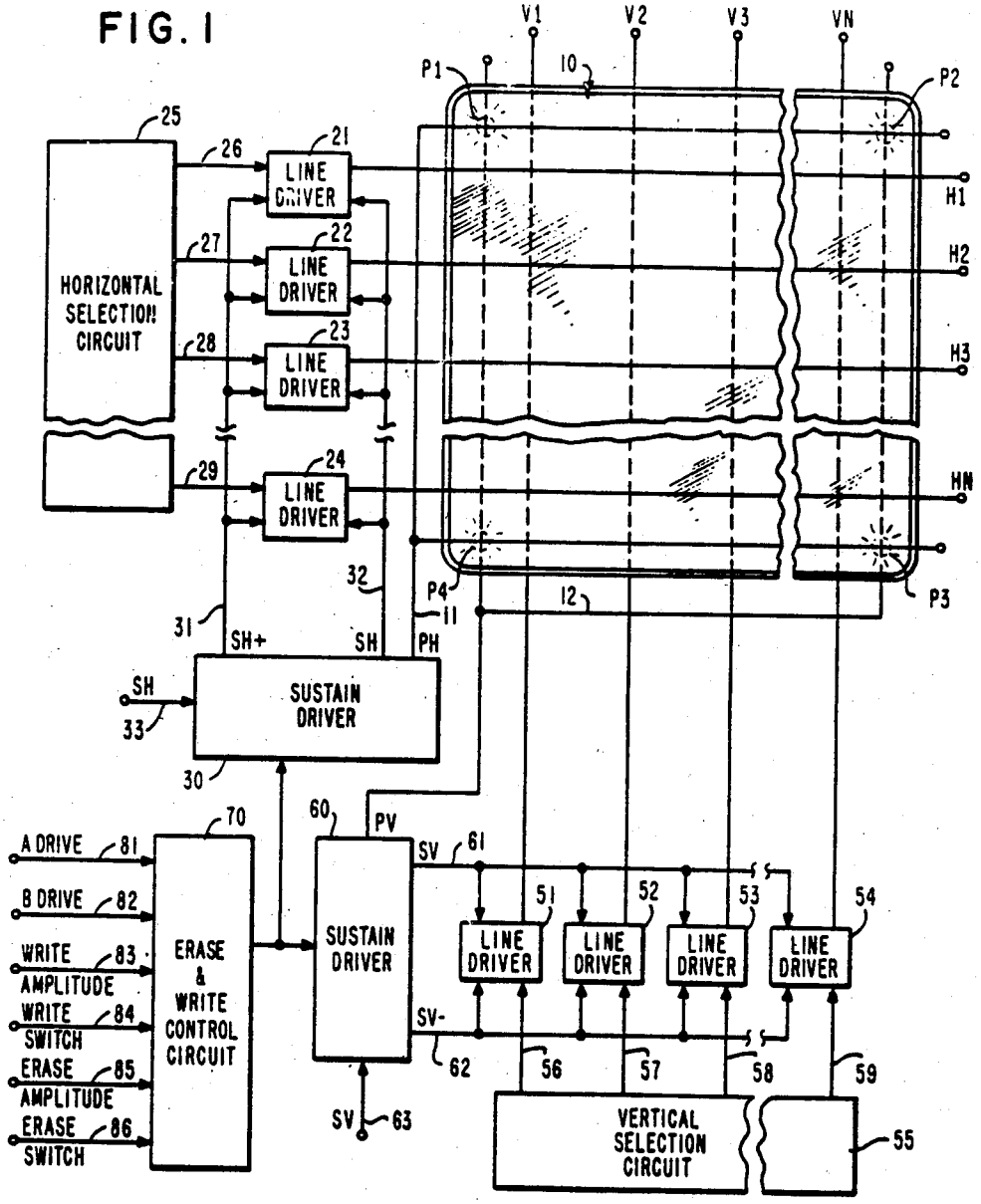
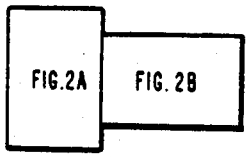
FIG. 2C

METHOD AND APPARATUS FOR GAS DISPLAY PANEL

CROSS REFERENCE TO A RELATED APPLICATION

This application is a continuation of application Ser. No. 268,219 filed 6-23-72, now abandoned which was a continuation of application Ser. No. 885,086 filed 12-15-69, now abandoned.

Application Ser. No. 785,210 filed Dec. 19, 1968 for Gas Panel Apparatus and Method by George M. Krembs, now U.S. Pat. No. 3,611,019.

BACKGROUND OF THE INVENTION (1) This invention relates to display devices and more particularly to display devices which employ gas panels.

(2) Earlier types of gas panel display devices employed rather complex circuit arrangements for driving the numerous horizontal and vertical coordinate drive lines. Since high voltages were involved, this required high voltage components, and in many cases a separate transformer and high voltage transistors were employed for each one of the vertical drive lines and each one of the horizontal drive lines. Integrated circuitry could not be employed because of the high voltage requirements. Consequently, the use of the more expensive transistors and transformers resulted in increased cost of manufacture and maintenance. Even then, moreover, there was a lack of uniformity in the magnitude of the drive signal over the entire panel.

The drive signals for the horizontal lines and vertical lines of gas panel devices must be uniform within a relatively high degree of precision and the dynamic characteristics of every cell must be uniform within a relatively high degree of precision if reliable writing and erasing operations are to take place selectively. As the number of cells per unit area on the panel increases, the need for still greater precision is required of the drive signals applied to the horizontal and vertical coordinate drive lines. The presence of half-select write and erase signals on non selected cells increase the problem as the density of cells on the gas panel increases. The half-select signals are signals applied to all gas cells on the selected horizontal line and the selected vertical line. The potential difference applied across the selected gas cell for a write operation exceeds the ignition potential of this cell. The violent plasma discharge activity in the selected gas cell tends to "spill" over to adjacent cells, and this raises the undesirable prospect of possibly igniting adjacent cells, particularly those receiving a half-select potential difference. When the write pulse of a selected gas cell is coincident in time with the sustain avalanche of adjacent cells, the violent plasma discharge activity taking place in the gas can and does change the turn-on and turn-off characteristics of affected gas cells nearby. Moreover, the number of sustaining cells adjacent to each given dark cell and their proximity is an ever changing combination of variables resulting in different cell histories and character fonts. This makes the turn-on characteristic of any given cell unpredictably variable, and it tends to make selective write and erase operations virtually impossible. One solution is to mechanically isolate cells so that plasma discharge activity in one cell does not "spill" over to adjacent cells. However, this poses many technical and economic problems if resort is made to the mechanical isolation of each cell by the so called "honeycomb" construction. Even the use of honeycomb construction does not provide electrical isolation, and the problem of half-select signals is nevertheless present on various non selected gas cells.

SUMMARY OF THE INVENTION

Accordingly, it is a feature of this invention to reduce the complexity of the circuits which drive the horizontal and vertical coordinate lines by using (a) a single driver to provide the high voltage for all of the horizontal coordinate lines, (b) using a single driver to provide the high voltage for all of the vertical coordinate lines, and (c) using a single transistor for each horizontal line and a single transistor for each vertical line through which pulses of low voltage and low power are algebraically added on the high voltage signals for the purpose of selectively performing write and erase operations. Since the transistors for the horizontal and vertical drive lines have lower voltage and power requirements, integrated circuitry may be employed which substantially reduces the cost of manufacture and repair. The problem of providing uniform high voltage drive signals is reduced by using only two drivers, one for the horizontal coordinate drive lines and one for the vertical coordinate drive lines, instead of using one high voltage driver for each coordinate drive line.

It is a feature of this invention to eliminate the problem created by half-select signals applied to the non selected cells on the selected horizontal coordinate drive line and the selected vertical coordinate drive line by providing (a) on the non selected horizontal drive lines a cancellation signal increment equal in magnitude and of the same polarity as the write or erase signal increment applied on the selected vertical coordinate drive line and (b) providing on the non selected vertical drive lines a cancellation signal increment equal in magnitude and of the same polarity as the write or erase signal increment applied on the selected horizontal coordinate drive line.

It is a further feature of this invention to eliminate the need for mechanical isolation of each gas cell, as by honeycombing, by making the sustain avalanche and the write avalanche non coincident. When the write pulse is coincident in time with the sustain avalanche on adjacent cells, the violent plasma discharge activity taking place in the gas can and does change the turn-on and turn-off characteristics of a nearby cell as pointed out earlier. This problem is minimized according to this invention by an improved method of operating a gas panel wherein the write pulse is moved to the trailing edge of the sustain waveform. When the sustain avalanche activity subsides, writing takes place. Moreover, to further isolate the timing between the sustain avalanche, which takes place at the leading edge of an applied signal, and the writing avalanche, which takes place near the trailing edge of an applied signal, the frequency of the applied waveform is reduced. In addition to providing greater separation between the sustain avalanche activity in non selected cells and the write avalanche activity in the selected cell, the lower frequency of the applied high voltage signal serves to nullify any potentially adverse effect of an early reduction in signal, or cancellation notch, on the trailing edge of the sustain signal for all non selected cells during a writing operation. Thus, the reduction in frequency of the high voltage signal during a writing operation serves the two-fold purpose of reducing intercell activity by separating the sustain avalanche on the leading edge from the write avalanche near the trailing edge, and it insures that the sustain signal has sufficient duration to perform a sustain operation on all non selected cells during a writing operation in a selected cell.

It is another feature of this invention to provide an improved apparatus and an improved method for gas display panels wherein selective write and erase operations reliably may be performed on gas panels which otherwise would be inoperable because of a low degree of cell to cell uniformity in conventional systems heretofore.

It is a feature of this invention to provide an improved method for operating gas panel display devices.

It is a further feature of this invention to provide an improved apparatus for gas panel display systems.

It is a further feature of this invention to provide a reliable gas panel display device which is relatively much less expensive to construct than earlier gas panel display devices.

In one arrangement according to this invention a first sustain driver supplies high voltage, in the form of a square wave train, to all of the horizontal coordinate drive lines, and a second sustain driver supplies high voltage, in the form of a square wave train which is displaced 90° from the square wave applied by the first sustain driver, to all of the vertical coordinate drive lines. All of the cells accordingly are sustained by a potential difference in the form of a square wave train, and the positive and negative excursions of the train have an amplitude less than the ignition potential but greater than the sustain potential of each gas cell. A line driver is provided for each horizontal coordinate drive line, and a horizontal selection circuit selects one of these line drivers during a write or erase operation. A line driver is provided for each vertical coordinate drive line, and a vertical selection circuit selects one of these line drivers during a write or erase operation. For write and erase operations a pulse is algebraically added to the high voltage signal supplied by the first and second sustain drivers. The first sustain driver has a first bus on which the algebraically added pulse adds to the high voltage signal excursion and a second bus on which the algebraically added pulse substracts from the high voltage signal excursion. The first and second busses are connected to each one of the horizontal line drivers. The horizontal line driver selected by the horizontal selection circuit supplies the increased composite signal excursion on the first bus to the selected horizontal line, and the remaining horizontal line drivers supply the decreased composite signal excursion to the non selected horizontal lines. The second sustain driver has a third bus on which the algebraically added pulse decreases the magnitude of the composite signal excursion and a fourth bus on which the algebraically added signal increases the magnitude of the composite signal excursion. The third and fourth busses are connected to each one of the vertical line drivers. The vertical selection circuit selects one of the vertical line drivers. The selected line driver supplies the composite signal with the increased excursion on the fourth bus to the selected vertical coordinate drive line, and the remaining vertical line drivers supply the composite signal with the decreased excursion on the third bus to the remaining vertical coordinate drive lines. For a write operation the frequency of the high voltage signals is reduced, and the selected cell on the gas panel is ignited after all of the remaining cells on the gas panel receive a sustain signal level. For an erase operation the high voltage signals supplied by the first and second sustain drivers are latched in a steady state for a given period of time and the erase pulse algebraically added on the high voltage signal causes the composite signal on the first bus to be increased and the composite signal on the second bus to be decreased. The pulse algebraically added on the high voltage signal causes the composite signal on the third bus to be increased and the composite signal on the fourth bus to be decreased. The decreased composite signal on the fourth bus is supplied through the selected line driver to the non selected vertical coordinate drive line, and the increased composite signal on the third bus is supplied through the remaining vertical line drivers to the remaining vertical coordinate drive lines. The potential difference applied across the selected gas cell is a pulse having an amplitude less than the sustain level and a polarity opposite to the polarity of the last sustain signal. The potential difference applied across the selected gas cell is large enough however to produce a weak avalanche and thereby reduces the charge, referred to as wall charge, across the selected gas cell. After the superimposed pulse terminates, the first and second sustain drivers remain in their steady state condition for a given period of time, which permits the selected gas cell to settle and remain in the dark or extinguished state when sustain operations subsequently commence. When sustain operations commence again, all previously ignited gas cells, except the selected gas cell, are reignited by the sustain signals.

The foregoing and other objects, features and advantages of the invention will be apparent from the following more particular description of a preferred embodiment of the invention, as illustrated in the accompanying drawings.

BRIEF DESCRIPTION OF THE DRAWINGS

FIG. 1 illustrates a gas panel system according to this invention.

FIG. 2C shows how FIGS. 2A and 2B should be arranged.

DESCRIPTION OF THE PREFERRED EMBODIMENT

Figure 2A:
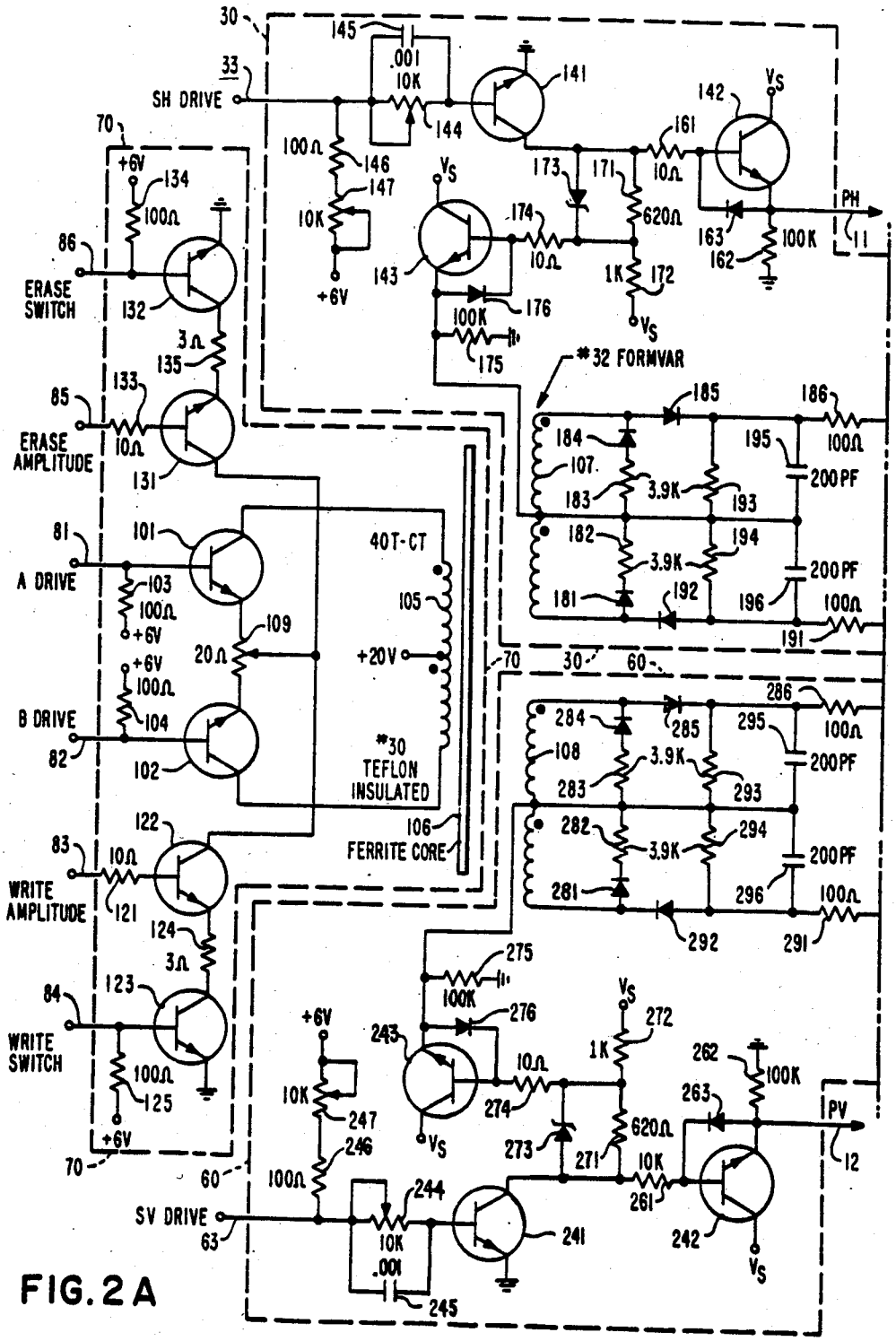
FIG. 2A and FIG. 2B illustrate in detail some of the system components shown in block form in FIG. 1.

In a system according to this invention a gas panel 10 has horizontal lines H1 through HN disposed thereover and vertical lines V1 through VN disposed there beneath. The gas panel 10 includes an illuminable gas within a sealed envelope, and regions within the vicinity of coordinate intersections of the vertical and horizontal lines define gas cells. The gas panel 10 may be of the type shown and described in the copending application referred to hereinbefore. The gas cells are selectively ignited, termed a write operation, by applying one potential to a horizontal line and a different potential to a vertical line, and the potential difference is sufficient to exceed the ignition potential of the illuminable gas. Once ignited, each gas cell is maintained in the ignited state by a periodic sustain signal on the vertical and horizontal lines of sufficient amplitude to equal or exceed the sustain level, but the sustain level is less than the ignition potential. Any one of the ignited cells may be extinguished, termed an erase operation, by first reducing the potential difference across the cell to zero, then applying a pulse of erase amplitude and polarity opposite that of the last sustain alternation, and last to maintain the zero potential for a fixed time period after the erase pulse. By selective writing operations information may be displayed in the form of characters, symbols, lines (graphics,) and the like on the gas panel 10, and such information may be regenerated as long as desired by sustain operations. Displayed information then may be removed selectively by erase operations.

Lines 11 and 12 are disposed as shown to define four pilot cells P1 through P4. The pilot cells are ignited initially, and they remain ignited throughout the use of the gas panel 10 as a display device. The pilot cells ionize the illuminable gas in the four corners of the gas panel 10, and this serves to provide a more uniform operation in the ignition of the remaining gas cells. The potential PH on the line 11 and the potential PV on the line 12 produce a potential difference sufficient to fire and sustain the pilot cells P1 through P4 at all times during the operation of the gas panel 10.

Line drivers 21 through 24 supply operating potentials to respective horizontal lines H1 through HN. A horizontal selection circuit 25 provides a signal of a given polarity on a selected one or more of the lines 26 through 29 thereby to select a given one or more of the line drivers 21 through 24 for a write or erase operation. A sustain driver 30 provides high voltage operating signals on a bus 31 and a bus 32 for controlling the operation of the line drivers 21 through 24. Input control signal is supplied on a line 33 to the sustain driver 30.

Line drivers 51 through 54 supply operating potentials to respective vertical lines V1 through VN. A vertical selection circuit 55 provides a signal of a given polarity on a selected one or more of the lines 56 through 59 thereby to select a given one or more of the line drivers 51 through 54 for a write or erase operation. A sustain driver 60 supplies high voltage operating signals on a bus 61 and a bus 62 to the line drivers 51 through 54. The sustain driver 60 receives a control input signal on a line 63.

The sustain driver 30 and the sustain driver 60 also receive control signals from an erase and write control circuit 70 whenever an erase or write operation takes place. At all other times the sustain driver 30 and the sustain driver 60 perform sustain operations in response to the control signals on respective input lines 33 and 63. The erase and write control circuit 70 receives control signals or voltages on lines 81 through 86 for performing write and erase operations. The lines 81, 82 and 84 receive positive control signals for performing a write operation, and the lines 81, 82, and 86 receive positive control signals for performing an erase operation. The control signals and voltages applied to the lines 81 through 86 during write and erase operations are discussed more fully hereinafter with reference to FIGS. 3, 4 and 5.

Figure 2B:
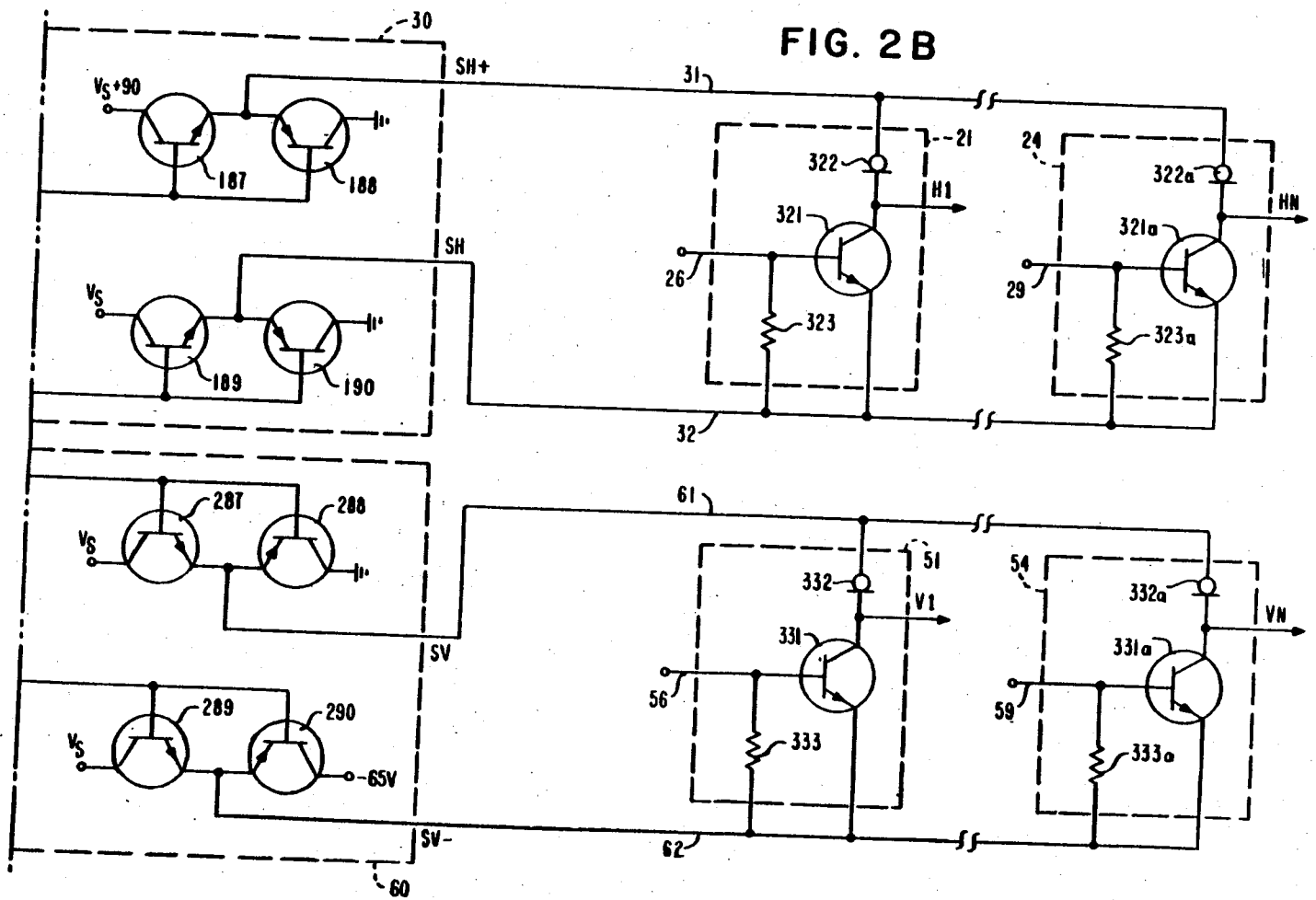

Reference is made next to FIGS. 2A and 2B which illustrates in detail the sustain driver 30, the sustain driver 60, the erase and write control circuit 70, and the line drivers illustrated in block form in FIG. 1. FIGS. 2A and 2B should be arranged as illustrated in FIG. 2C.

The lines 81 and 82 in FIG. 2A are connected to the base of respective transistors 101 and 102. The resistors 103 and 104 are connected between the respective lines 81 and 82 to sources of potential. The collector electrodes of the transistors 101 and 102 are connected to the opposite ends of a primary winding 105 which has its center tap connected to a source of operating potential. The primary winding 105 is coupled through a magnetic core 106 to secondary windings 107 and 108. A resistor 109 is connected between the emitters of the transistors 101 and 102.

The control line 83 in FIG. 2A is connected through a resistor 121 to the base of a transistor 122. The collector of a transistor 123 is collected through a resistor 124 to the emitter of the transistor 122. The control line 84 is connected to the base of the transistor 123, and a resistor 125 is connected from the base of the transistor 123 to a source of potential. The control line 83 is connected to a fixed but adjustable potential (from 0 to 6 V) to control the amplitude of the write pulses. When the transistor 123 is turned on by a signal on the control line 84, the transistor 122 is turned on and controlled as a current source by the potential on line 83. The magnitude of the current source is controlled by the magnitude of the positive potential on the control line 83. The transistors 122 and 123 are operated into the conductive state whenever a write operation is to be performed. Whenever both of the transistors 122 and 123 are operated, they serve as a controlled current source and a switch which connects the variable tap on the resistor 109 to ground.

Control line 86 in FIG. 2A receives control signals during an erase operation which simultaneously operates transistors 131 and 132 into the conductive state. The control line 85, supplied with a positive, adjustable voltage is connected through a resistor 133 to the base of the transistor 131. The control line 86 is connected to the base of the transistor 132. The base of the transistor 132 is connected through a resistor 134 to a source of potential. A resistor 135 is connected between the emitter of the transistor 131 and the collector of the transistor 132. Whenever an erase operation takes place, the control line 86 is energized to operate the transistors 131 and 132 simultaneously, and they serve as an adjustable current source and switch which then connects the variable tap on the resistor 109 to ground.

Next, the sustain driver 30 in FIGS. 2A and 2B is discussed. A pulse train, designated SH drive, on the control line 33 operates the transistor 141 the output of which (1) drives the transistor 142 to provide drive signals on the line 11 for the purpose of igniting and maintaining the ignition of the pilot cells and (2) drives the transistor 143, connected to the center tap of the secondary winding 107, for the purpose of providing output signals on the busses 31 and 32 thereby to operate the line drivers 21 through 24 in FIG. 2B.

The control line 33 in FIG. 2 is connected through an RC circuit to the base of the transistor 141. The RC circuit includes a resistor 144 and a condenser 145. The control line 33 is connected through resistors 146 and 147 to a source of potential. The collector of the transistor 141 is connected through a resistor 161 to the base of the transistor 142. The emitter of the transistor 142 is connected through a resistor 162 to ground. A diode 163 is connected between the emitter and the base of the transistor 142. The emitter of the transistor 142 is connected to the horizontal drive line 11 which provides horizontal drive for the pilot cells P1–P4.

The collector of the transistor 141 in FIG. 2A is connected through resistors 171 and 172 to a source of operating potential. A Zener diode 173 is connected across the resistor 171. A resistor 174 is connected between the base of the transistor 143 and the junction point of the resistors 171 and 172. The emitter of the transistor 143 is connected through a resistor 175 to ground, and the emitter is connected also to the center tap of the secondary winding 107. A diode 176 is connected between the emitter and the base of the transistor 143. The collector of the transistor 143 is connected to a source of operating potential.

A series circuit including a diode 181 and a resistor 182 is connected across the lower half of the secondary winding 107, and a series circuit including a resistor 183 and a diode 184 is connected across the upper half of the secondary winding 107. The upper end of the secondary winding 107 is connected through a diode 185 and a resistor 186 to the base electrodes of transistors 187 and 188. A pair of transistors 188 and 190 have their base electrodes connected through a resistor 191 and a diode 192 to the lower end of the secondary winding 107. Resistors 193 and 194 are connected in parallel with respective condensers 195 and 196, as shown.

A pulse train, designated SV drive, on the line 63 in FIG. 2A operates the transistor 241 the output of which (1) operates the transistor 242 to supply drive signals on the vertical drive line 12 which provides vertical drive for the pilot cells P1 through P4 in FIG. 1 and (2) operates the transistor 243 to supply output signals on the busses 61 and 62 thereby to operate the line drivers 51 through 54 in FIG. 2B.

The line 63 in FIG. 2 is connected through an RC circuit to the base of the transistor 241. The RC circuit includes a resistor 244 and a condenser 245. The line 63 is connected through resistors 246 and 247 to a source of potential. The collector of the transistor 241 is connected through a resistor 261 to the base of the transistor 242. The emitter of the transistor 242 is connected through a resistor 262 to ground. A diode 263 is connected between the base and the emitter of the transistor 242. The emitter of the transistor 242 is connected to the drive line 12, and the collector is connected to a source of operating potential.

The collector of the transistor 241 is connected through the resistors 271 and 272 to a source of operating potential. A Zener diode 273 is connected across the resistor 271. A resistor 274 is connected between the base of the transistor 243 and the junction of the resistors 271 and 272. A resistor 275 is connected between the emitter of the transistor 243 and ground. A diode 276 is connected between the emitter and the base of the transistor 243. The emitter of the transistor 243 is connected to the center tap of the secondary winding 108, and the collector is connected to a source of operating potential.

A series circuit including a diode 281 and a resistor 282 is connected across the lower half of the secondary winding 108, and a series circuit including a resistor 283 and a diode 284 is connected across the upper half of the secondary winding 108. A diode 285 and a resistor 286 are connected in series to the base electrodes of transistors 287 and 288. Transistors 289 and 290 have their base electrodes connected through a resistor 291 and a diode 292 to the lower end of the secondary winding 108. Resistors 293 and 294 are connected in parallel with respective condensers 295 and 296, as shown.

Figure 3:
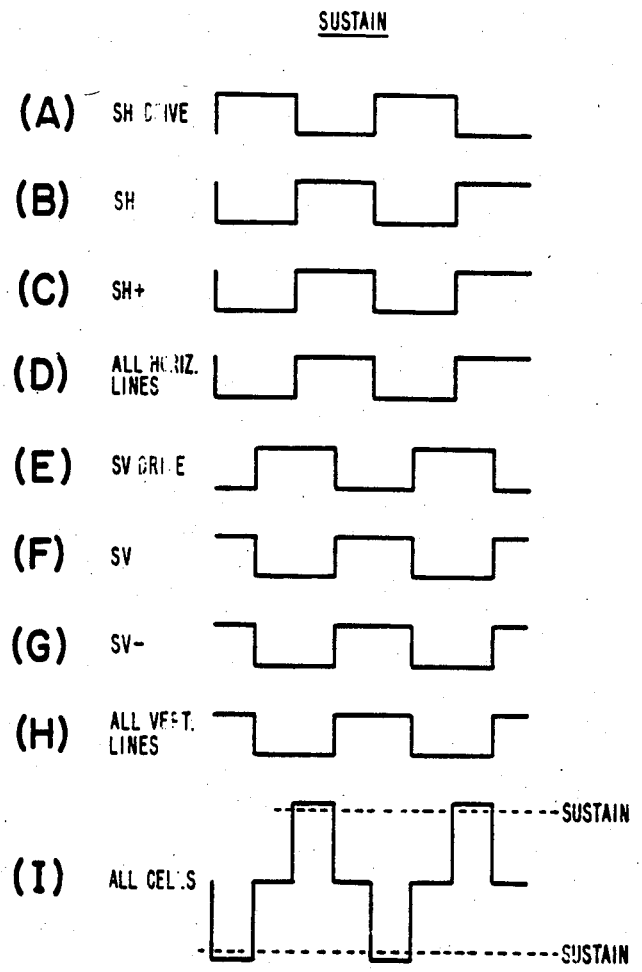
FIG. 3 shows waveforms which are helpful in explaining a sustain operation.

Reference is made next to FIG. 2B which illustrates in detail the line drivers 21 through 24 shown in block form in FIG. 1. In FIG. 2B the line drivers 21 and 24 are arbitrarily illustrated. The line driver 21 includes a transistor 321 with a constant current diode 322 connected between the collector and the drive line 31. The emitter of the transistor 321 is connected to the drive line 32. The base of the transistor 321 is connected by the line 26 to the horizontal selection circuits 25 in FIG. 1. A resistor 323 is connected between the base of the transistor 321 and the drive line 32. The drive line H1 is connected to the collector of the transistor 321. The line driver 24 in FIG. 3 is identical in construction to the line drive 21, and the same reference numerals are used with the letter "a" affixed to designate corresponding parts.

Figure 4:
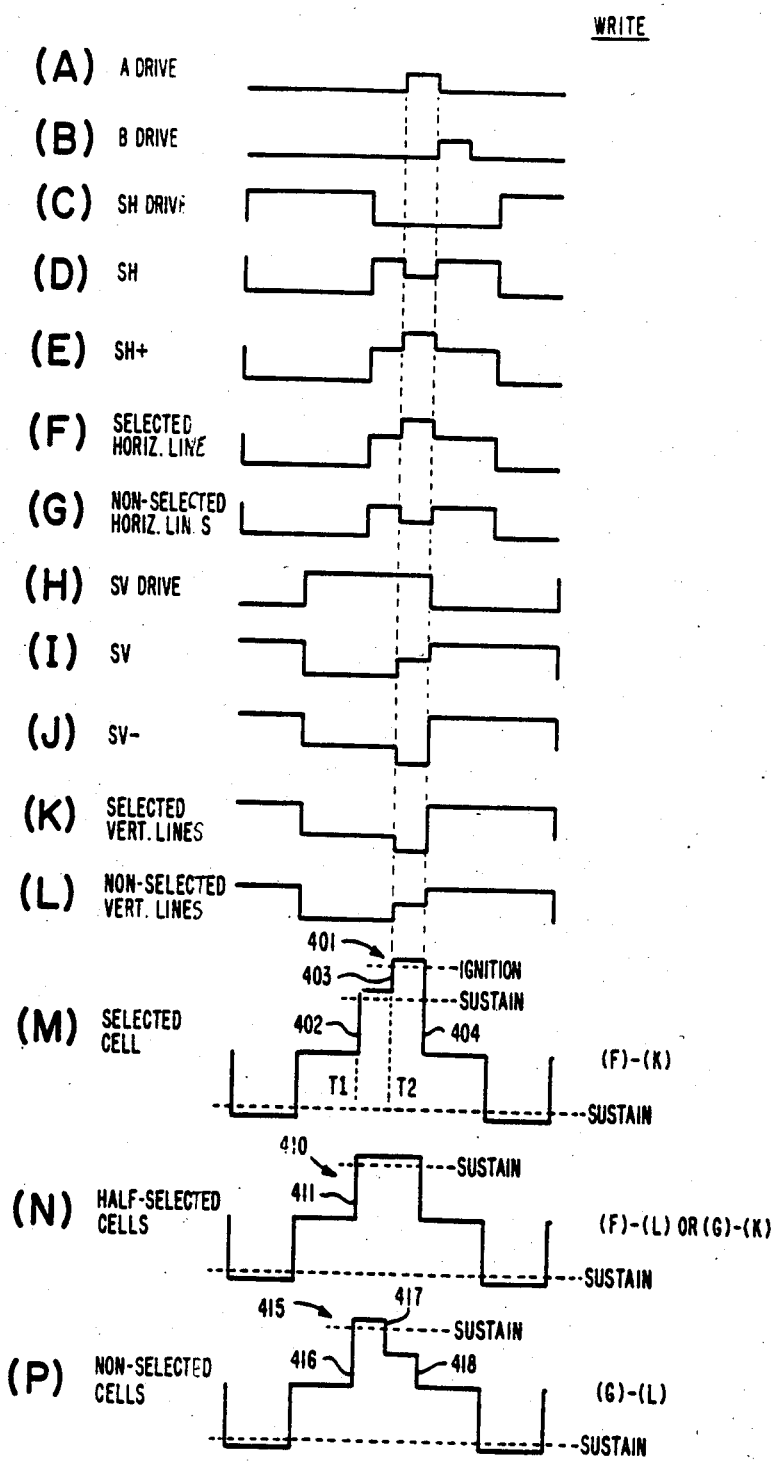
FIG. 4 shows waveforms which are helpful in explaining a write operation.

FIG. 2B also illustrates in detail the vertical line drivers 51 through 54 shown in block form in FIG. 1. Line drivers 51 and 54 are arbitrarily illustrated. The line driver 51 includes a transistor 331. The emitter of the transistor 331 is connected to the drive line 62, and the collector of the transistor 331 is connected through a constant current diode 332 to the drive line 61. The collector of 331 is connected also to the drive line VI. The base of the transistor 331 is connected by the line 56 to the vertical selection circuits 55 in FIG. 1. A resistor 333 in FIG. 4 is connected between the base of the transistor 331 and the drive line 62. The vertical line driver 54 is identical in construction to the vertical line driver 51 and like reference numerals with the letter "a" affixed are used to designate corresponding parts.

The system in FIG. 1 is operated to display information on the gas panel 10 by igniting selective cells to form letters, numerals, and characters of any desired configuration. Information is written on the panel by igniting a selected pattern of gas cells. The potential difference supplied across the selected cells exceeds the ignition potential for a write operation. Information, once written, is sustained in the ignited state by sustain signals applied to all horizontal and vertical lines. The sustain signal on the horizontal and vertical lines creates a potential difference between such lines which is less than the ignition level but greater than the sustain level, thereby to maintain lighted patterns of gas cells in the ignited state. Information is erased by reducing the potential difference across a selected cell below the sustain level for a given period of time which time period varies with the mixture of gasses employed in the gas panel, and the sustain signal is applied again thereby to reignite all gas cells, except the erased gas cell, which previously were ignited. Next the operation of the system in FIG. 1 is discussed.

Sustain operations are described first. For this purpose reference is made to FIGS. 1, 2A and 2B for the circuits and FIG. 3 for the waveforms. The SH drive signals on the line 33 in FIG. 2A are a square wavetrain such as shown in FIG. 3A. The SH drive signals on the line 33 in FIG. 2A are inverted by the transistor 141. The inverted SH drive signals undergo current amplification in the transistor 142, connected in an emitter follower configuration, and the output signals are supplied on the line 11 to the pilot gas cells P1 through P4 in FIG. 1. The inverted SH drive signals likewise undergo current amplification in the transistor 143, connected in an emitter-follower configuration, and they are supplied through the center tap of the secondary winding 107, through the resistor 186 to the base electrodes of the pair of transistors 187 and 188 which serve as a complementary pair of emitter-followers. The output signals on the bus 31, designated SH+, are supplied to the line drivers 21 and 24 in FIG. 2B. This SH+ signal is illustrated in FIG. 3C. The signals supplied to the center tap of the secondary winding 107 are supplied also through the resistor 191 to the base of the transistors 189 and 190 which likewise are connected as a pair of complementary emitter-followers. The output signals from the transistors 189 and 190 on the bus 32, designated SH, are supplied to the line drivers 21 and 24. These signals have the same magnitude and polarity as the SH+ signals on the bus 31. The SH signal is shown in FIG. 3B.

The signals SH+ and SH on the respective busses 31 and 32 are supplied to the respective collector and emitter electrodes of the transistors 321 and 321A in FIG. 2B. The SH+ signals are supplied through the constant current diodes 322 and 322A to the collector electrodes of the respective transistors 321 and 321A. For a sustain operation the horizontal selection circuit 25 in FIG. 1 need not supply a selection signal level on a selected one of the lines 26 through 29 to a respective one of the line drivers 21 through 24. If it does, however, no harm results for reasons pointed out below. If deselect signals are supplied on the lines 26 through 29 in FIG. 1, they have a given magnitude which is sufficiently more positive than the SH signal to cause the transistors in the drivers 26 through 29 to conduct. Consequently the transistors 321 and 321A in FIG. 2B conduct, and the signals on the lines H1 and HN have a polarity and magnitude equal to the SH signal on the bus 32. Incidentally, when transistors 321 and 321A are off, the magnitude of the signals on the lines H1 and HN have the same polarity and magnitude of the signals SH+ except for a slight voltage drop in the constant current diodes 322 and 322A, and it is seen therefore that it is inconsequential for sustain operation, as pointed out above, whether or not the transistors in the drivers 21 through 24 are on or off, i.e., selected or deselected by the horizontal selects circuit 25. The lines H2 and H3 in FIG. 1 are supplied with sustain signals by the associated line drivers 22 and 23 which are identical in polarity and magnitude to the signals supplied to the lines H1 and HN as explained with reference to FIG. 2B. The sustain signal supplied to the horizontal lines H1 through HN is illustrated in FIG. 3D. It is readily seen by inspection that the waveform in FIG. 3D is like the waveforms of FIGS. 3B and 3C.

The SV drive signal applied to the line 63 in FIG. 2A is a square wave train as illustrated in FIG. 3E. The SV drive signal is identical to the SH drive signal except the SV drive signal is 90° behind the SH drive signal. This signal is inverted by the transistor 241. The inverted output from the transistor 241 undergoes current amplification in the transistor 242, connected in an emitter-follower configuration, and its output is supplied on the line 12 to the pilot cells P1 through P4 in FIG. 1. The inverted output signal from the transistor 241 is likewise supplied to the base of the transistor 243 which also is connected in an emitter-follower configuration to provide current amplification. The output of the transistor 243 is connected to the center tap of the secondary winding 108, through the resistor 286 to the base electrodes of the transistors 287 and 288 in FIG. 2B which are connected as a pair of complementary emitter-followers to provide current amplification. The output signals SV from the transistors 287 and 288 on the bus 61 is a square wave train as shown in FIG. 3F. The output signal from the transistor 243 in FIG. 2A is connected to the center tap of the secondary winding 108, through the resistor 291 to the base electrode of the transistors 289 and 290 which likewise are connected as a complementary pair of emitter-followers to provide current amplification. The output signals SV− from the transistors 289 and 290 on the bus 62 is a square wave train as illustrated in FIG. 3G. The signal SV and the signal SV− on the respective busses 61 and 62 have the same magnitude and polarity as readily seen by inspection of FIGS. 3F and 3G. The SV signal on the line 61 in FIG. 2B is supplied through the constant current diodes 332 and 332A to the collector electrodes of the respective transistors 331 and 331A. The SV− signal on the line 62 in FIG. 2B is supplied to the emitter electrodes of the transistors 331 and 331A. For a sustain operation the vertical selection circuit 55 in FIG. 1 may or may not supply a selection level on one of the lines 56 through 59 to a respective one of the line drivers 51 through 54. If a selection level is supplied to a given one of the line drivers 51 through 54, it is inconsequential for reasons pointed out above. Let it be assumed that deselection levels are supplied. Referring more specifically to the line drivers 51 and 54 in FIG. 2B, such deselection signals on the lines 56 and 59 drive the respective transistors 331 and 331A to the non-conductive or off state. For this purpose the signal levels on the lines 56 and 59 may have the same magnitude and polarity as the SV− signal on the bus 62. The transistors 331 and 331A accordingly are driven off during a sustain operation, and the signals on the lines V1 and VN are substantially identical in polarity and magnitude to the SV signal on the bus 61 except for a slight potential drop through the respective constant current diodes 332 and 332A. The signals on the lines V1 and VN are a square wave train as illustrated in FIG. 3H. Sustain signals of the identical polarity and magnitude as that illustrated in FIG. 3H are supplied by the line drivers 52 and 53 in FIG. 1 to the vertical lines V2 and V3.

The potential difference between the horizontal lines H1 through HN and the vertical lines V1 through VN at each coordinate intersection of the gas panel 10 in FIG. 1 must exceed the sustain level for the particular gas, or mixture of gases, employed in the gas panel for a continuous indication after firing. The potential on each horizontal line, taken alone, is insufficient to equal or exceed the sustain level of the gas cells at each coordinate intersection of the gas panel in FIG. 1, and has only one polarity; the potential on each vertical line, taken alone, is likewise insufficient to equal or exceed the sustain level of the gas cells at each coordinate intersection of the gas panel 10 in FIG. 1 and has the opposite polarity. However, the potential on each horizontal line and the potential on each vertical line, taken together, provide an alternating potential difference across the gas panel 10 at each coordinate intersection which equals or exceeds the sustain level of the particular gas or mixture of gasses employed. The potential on each of the horizontal lines of the gas panel in FIG. 1 is a square wave train as illustrated in FIG. 3D, and the potential on each of the vertical lines is a square wave train as illustrated in FIG. 3H. The resulting potential difference across each gas cell of the panel in FIG. 1 is a square wave train as illustrated in FIG. 3I. The waveform in FIG. 3I is obtained by subtracting the wave form in FIG. 3H from the waveform in FIG. 3D. The sustain level is indicated by dotted lines in FIG. 3I. The square waves in FIG. 3I exceed the sustain level on both the positive and the negative excursions. Each one of the positive or negative excursions is sufficient to maintain all previously ignited cells in the illuminated state. However, the positive and negative excursions in FIG. 3I are not sufficient to ignite any cell previously in the non-illuminated state.

Next a write operation is described. The waveforms in FIG. 4 are helpful in explaining the events which take place in the circuits of FIGS. 1, 2A and 2B during a write operation. For a write operation the frequency of the SH drive signal and the SV drive signal is reduced substantially below the frequency these signals having during a sustain operation. In one arrangement according to this invention a gas mixture of 99.9% Neon and 0.1% Argon was employed in the gas panel. The frequency used for the SH drive signal and the SV drive signal was 30 kilohertz per second for sustain operations. The frequency of the SH drive signal and the SV drive signal was reduced to 15 kilohertz per second for a write operation. It is a feature of this invention to perform sustain operations at all times, even during write operations, on all previously ignited cells. In other words, sustain operations on all ignited cells are carried out at all times except when a particular one of the ignited cells is selected for an erase operation. The SH and SV drive signals provide the voltage waveforms to the cells of the display panel in FIG. 1 which perform a sustain operation on all previously ignited cells during a write operation, and during such operation a selected dark or non-illuminated cell is ignited. Square waves are applied across the cells of the panel in FIG. 1 for this purpose. It is seen, therefore, that during a write operation the square waves perform two functions i.e. sustain and write. The leading edge of a square wave potential difference applied across a previously ignited gas cell performs a sustain operation. It is necessary that the leading edge of the square wave rise to an amplitude equal to or in excess of the sustain signal level of the gas cell, and it is desirable that the write operation take place at a subsequent point in time. This time delay permits the plasma discharge activity of the sustained gas cells to settle down, and a write operation then may take place with the least disturbance on adjacent dark or non-illuminated cells. For this reason the write operation is timed to take place near the termination of a square wave signal applied to the selected cell. It is for the purpose of providing an extension of the period of time between the leading edge of a square wave pulse which provides for the sustain function and the latter part of a square wave which provides for the writing function that the frequency of the SH and SV drive signals is reduced for a writing operation. The ignited gas cells tend to settle about 4–8 microseconds after a sustain operation, the precise time depending upon the mixture of gasses used. For the particular gas mixture mentioned above a frequency of 30 kilocycles per second for the SH drive signal and the SV drive signal is adequate to perform sustain operations, and a frequency of 15 kilocycles per second is adequate for write operation. The lower frequency provides the needed time differential between the leading edge of the square wave potential difference applied to the gas cells for a sustain operation and the latter part which provides for a write operation.

For a write operation the SH drive signal applied to the line 33 in FIG. 2A is shown in FIG. 4C, and it is readily seen by inspection that the pulses are twice as wide as the SH drive signal shown in FIG. 3A. The SH drive signal on line 33 provides the corresponding inverted signals SH in FIG. 4D and SH+ in FIG. 4E on the lines 31 and 32 in FIG. 2B as explained above. A given one of the line drivers 21 through 24 in FIG. 1 is selected during a write operation, and the remaining ones of these line drivers are deselected. The selected line driver is driven off, and the deselected line drivers are driven on. For this purpose the selected line driver receives a signal on the associated one of the lines 26 through 29 from the horizontal selection circuit 25 which is equal to or less than the SH drive signal on the bus 32. The deselected line drivers receives signals on the associated lines 26 through 29 which are positive with respect to the SH drive signal on the bus 32.

If the line driver 21 in FIG. 2B is selected, it receives a signal on the line 26 which is equal to or less than the SH signal on the bus 32, and the transistor 321 is driven off. In this case the line drivers 22 through 24 in FIG. 1 are deselected. The line driver 24 in FIG. 2B accordingly receives a signal on the line 29 which is more positive than the SH signal on the bus 32, and the transistor 321A is driven on. The corresponding transistor in the line drivers 22 and 23 in FIG. 1 are driven on. Since the transistor 321 of the selected line driver 21 is off, the waveform of the signal on the selected line H1 follows the waveform of the signal SH+ on the bus 31 except for a slight voltage drop across the constant current diode 322. The waveform of the signal on the selected line H1 is illustrated in FIG. 4F. The signal on each of the non-selected horizontal drive lines is illustrated in FIG. 4G. Referring to the line driver 24 in FIG. 2B, the transistor 321A is conductive, and the signal on the non-selected line HN follows the waveform of the signal SH on the bus 32.

The SV drive signal on the line 63 in FIG. 2A is illustrated in FIG. 4H. The SV drive signal is identical to the SH drive signal except the SV drive signal is 90° behind the SH drive signal. The SV drive signal provides the SV and the SV− signals on the respective busses 61 and 62 in FIG. 2B for reasons explained above. The waveform of the SV signal is shown in FIG. 4I, and the waveform of the SV− signal is shown in FIG. 4J.

For a write operation a given one of the vertical line drivers 51 through 54 in FIG. 1 is selected, and the remaining ones of these line drivers are deselected. The select and deselect signals are supplied by the vertical selection circuit 55 in FIG. 1 on the lines 56 through 59. The selected vertical line driver is driven on, and the deselected line drivers are driven off. Referring to FIG. 2B, the transistor 331 is driven on if the line driver 51 is selected. For this purpose the selection signal on the line 56 is made more positive than the SV− signal on the bus 62. Consequently, the transistor 331A is driven off. The waveform of the signal on the selected line V1 in FIG. 2B follows the waveform of the signal SV− on the bus 62 since the transistor 331 is conductive. The waveform of the signal on the selected vertical line VI is illustrated in FIG. 4K. The waveform of the signal on the non-selected vertical lines V2 through V4 is illustrated in FIG. 4L, and they are identical to the waveform of the signal SV on the bus 61 except for a slight voltage drop through the associated constant current diodes. The line driver 54, for example, in FIG. 2B has its transistor 331A driven off, and the waveform on the non-selected line VN follows the waveform of the signal SV on the bus 61 except for a slight voltage drop through the constant current diode 332A.

For a write operation the erase and write control circuit 70 in FIG. 2A receives a positive signal, designated write amplitude, on the line 83 which establishes the magnitude of constant current generated by the transistor 122 when it is in the conductive state. A positive signal, designated write switch, is applied on the line 84 to drive the transistor 123 into the conductive state. When the transistor 123 is conductive, then the transistor 122 will be conductive. If the transistors 122 and 123 are conductive, a path is provided from the center tap of the resistor 109 to ground. A positive A drive pulse, shown in FIG. 4A, is applied on the line 81. The positive A drive pulse on the line 81 drives the transistor 101 into the conductive state, and current flows from the voltage source connected to the center tap of the primary winding 105 through the upper half of the primary winding 105, the transistor 101, through the resistor 109 to the center tap, and then through the transistor 122, the resistor 124, and the transistor 123 to ground. The magnitude of the current in the upper half of the primary winding 105 is controlled by current source transistor 122. This controlled current pulse induces a pulse signal in the secondary windings 107 and 108. The signal induced in the secondary winding 107 is algebraically added on the inverted SH drive signal supplied to the center tap of the secondary winding 107. This algebraically added pulse causes the upper end of the secondary winding 107 to become more positive than the center and lower end of the secondary winding 107. The Diode 185 passes the composite signal through the resistor 186 to the base of the transistors 187 and 188. This composite signal, SH+, is then connected to bus 31, and is illustrated in FIG. 4E. Since the lower end of the winding 107 is driven negatively, the diode 192 passes this composite signal through the resistor 191 to the base of the transistors 189 and 190 in FIG. 2B. This composite signal, SH, is then connected to bus 32, and this is illustrated in FIG. 4D. Since the selected horizontal line has a waveform which follows the waveform of the SH+ signal on the bus 31, the effect of the algebraically added pulse is to increase in a positive direction the signal on the selected horizontal line. This is shown in FIG. 4F. The waveform of the signal on the non-selected horizontal lines follows the waveform of the SH signal on the bus 32, and the effect of the algebraically added pulse is to decrease in a negative direction the signal on the non-selected horizontal lines. This is shown in FIG. 4G.

The A drive pulse on the line 81 in FIG. 2A causes a signal to be induced in the secondary winding 108, the polarity of which is positive at the upper end of the winding 108 and negative at the lower end. The induced positive signal at the upper end of the secondary winding 108, algebraically added to the inverted SV drive signal applied to the center tap of the secondary winding 108, is passed by the diode 285 in FIG. 2A through the resistor 286 to the base of the transistors 287 and 288 in FIG. 2B. This composite signal, SV, is then connected to bus 61. Since the SV drive signal is negative at this time, the induced positive pulse decreases the magnitude of the SV waveform as shown in FIG. 4I.

The induced negative signal at the lower end of the secondary winding 108, algebraically added to the inverted SV drive signal applied to the center tap of the secondary winding 108, is passed by the diode 292 through the resistor 291 to the base of the transistors 289 and 290 in FIG. 2B. This composite signal, SV−, is then connected to bus 62, and the net effect is to drive the bus 62 more negative as illustrated in FIG. 4J. The waveform of the potential on the selected vertical line is illustrated in FIG. 4K. The waveform of the potential on the selected vertical line follows the waveform of the SV− signal as explained above. Consequently, the effect of the induced negative pulse is to drive the selected vertical line more negatively as shown in FIG. 4K.

The waveform of the signals on the non-selected vertical lines follows the waveform of the SV signal on the bus 61 as explained above. The waveform of the signals on the non-selected vertical lines is illustrated in FIG. 4L, and the effect of the induced positive pulse is to decrease the magnitude of the potential on the non-selected vertical lines.

The potential difference between the horizontal and vertical lines at the coordinate intersection of the selected cell is shown in FIG. 4M. This waveform is obtained by subtracting the signal on the selected vertical line from the signal on the selected horizontal line. The signal on the selected horizontal line is illustrated in FIG. 4F, and the signal on the selected vertical line is illustrated in FIG. 4K. By subtracting the waveform in FIG. 4K from the waveform in FIG. 4F, the result is the waveform in FIG. 4M. The effect of the induced pulse, resulting from the A drive pulse, is to increase the potential difference across the selected cell, and the amplitude of the induced pulse is sufficient to exceed the ignition level indicated by the dotted line in FIG. 4M. It is pointed out that the termination of the induced pulse in FIG. 4M coincides with the termination of the waveform representing the potential difference applied across the selected cell. The positive pulse 401 in FIG. 4M has a first leading edge 402 and a second leading edge 403. The leading edge 402 occurs at time T1, and the leading edge 403 occurs at time T2. At time T1 sustain operations take place in all cells except the selected cell which is dark for a write operation. At time T2 a write operation in the selected cell commences. The leading edge 403 initiates the writing operation, and the writing operation is terminated by the trailing edge 404 of the pulse 401. The time delay between the time T1 and the time T2 is sufficient to permit the gas mixture in the sustained non selected cells to settle sufficiently for a writing operation to commence at time T2 without danger of "spilling" taking place. Spilling refers to the undesirable and unintentional ignition of a dark cell near the selected cell during a writing operation. This might tend to occur because the violent plasma discharge activity of the gasses in a nearby sustained cell is followed closely by the violent plasma discharge activity of the gasses of a nearby selected cell during a write operation.

The signal level applied to half-selected cells is shown in FIG. 4N, and this waveform results from the potential difference obtained by subtracting the waveform in FIG. 4L from the waveform in FIG. 4F or subtracting the waveform in FIG. 4K from the waveform in FIG. 4G. The half-selected cells are those cells on the selected vertical line other than the selected cell and the cells on the selected horizontal line other than the selected cell. To illustrate, the selected cell is cell (V1, H1) whenever the lines H1 and V1 are selected. In this case the half-selected cells are all of the cells on the horizontal line H1 except the selected cell (H1, V1) and all of the cells on the vertical line V1 except the selected cell (H1, V1). The non-selected cells are the remaining cells in FIG. 1 in this case. More specifically, the non-selected cells are all cells except those cells lying along the line H1 or the line V1. The potential difference across the non-selected cells is a waveform illustrated in FIG. 4P. This waveform is the result of the potential difference obtained by subtracting the waveform in FIG. 4L from the waveform in FIG. 4G. The positive pulse 410 in FIG. 4N has a leading edge 411 which performs a sustain operation in the half-selected cells, and the positive pulse 415 in FIG. 4P has a leading edge 416 which performs a sustain operation in the non-selected cells. It is pointed out that the waveforms in FIGS. 4M, 4N and 4P are identical to the sustain wave form in FIG. 3B except for the effect of the induced pulse which increases the amplitude of pulse 401 in FIG. 4M and decreases the amplitude of the pulse 415 in FIG. 4P. The increased amplitude of the pulse 401 in FIG. 4M is required to exceed the ignition potential of the selected cell thereby to perform a write operation of igniting the selected cell. In this connection it is pointed out that the induced pulse increases the potential difference across the selected, and only the selected, cell. The amplitude of the waveform across the half-selected cells, shown in FIG. 4N, is not changed by the induced pulse. In fact, the waveform of FIG. 4N is identical to the waveform of FIG. 3I except for the change in width of the pulses resulting from the use of a lower frequency during a write operation.

The effect of the induced pulse in a writing operation on the waveform of the potential difference applied across the non-selected cells is shown in FIG. 4P, and the pulse 415 has a first trailing edge 417, occuring earlier than the trailing edge 418, displaced in time as shown. The trailing edge 417 occurs earlier than the trailing edge 418 because the induced pulse causes both the non-selected vertical lines to increase and the non-selected horizontal lines to decrease in potential. However, as pointed out above with respect to FIG. 4M, the sustain operation for the ignited, non-selected cells commences at the time T1 and terminates at the time T2, and the positive excursion of the pulse 415 in FIG. 4P is sufficient in amplitude and duration to perform a sustain operation during a writing operation of the non-selected cells which were previously ignited.

After the A drive pulse on the line 81 in FIG. 2A terminates, a B drive pulse, shown in FIG. 4B, is applied to the line 82 in FIG. 2A for the purpose of resetting the ferrite core 106. When the A drive pulse on the line 81 terminates, the transistor 101 changes to the non-conductive state. The positive B drive pulse on the line 82 drives the transistor 102 into the conductive state, and current flows from the voltage source at the center tap of the primary winding 105 through the lower half of this winding, the transistor 102, the resistor 109 to its center tap, the transistor 122, the resistor 124, and the transistor 123 to ground. The current through the lower portion of the primary winding 105 resets the ferrite core 106, and signals are induced in the secondary windings 107 and 108. The polarity of the induced pulse drives the lower end of the windings 107 and 108 positively, and it drives the upper ends of these windings negatively. The diode 185 blocks the induced negative signal, and the diode 192 blocks the induced positive signal, thereby preventing the induced signal from affecting the signals on the busses 31 and 32 in FIG. 2B. In like fashion the diode 285 in FIG. 2A blocks the induced negative signal, and the diode 292 blocks the induced positive signal, thereby preventing the induced signal from affecting the signals on the busses 61 and 62 in FIG. 2B. The diode 184 in FIG. 2A conducts, and the induced negative signal is dissipated in the resistor 183. The diode 181 conducts and the resistor 182 dissipates the induced positive signal. The diode 284 conducts and the resistor 283 dissipates the induced negative signal. The diode 281 conducts and the resistor 282 dissipates the induced positive signal. Consequently, the B drive signal resets the ferrite core 106 without affecting the control signals supplied to the busses 31 and 32 and the busses 61 and 62 in FIG. 2B. As soon as the B drive pulse terminates, the positive signal, designated write switch, on the line 84 is removed if there are no further writing operations. If further writing operations are to take place, the horizontal selection circuit 25 in FIG. 25 selects a given one of the line drivers 21 through 24, and the vertical selection 55 selects one of the line drivers 51 through 54. An A drive pulse and a B drive pulse are applied in the manner previously explained to perform another writing operation in a different selected cell. A series of writing operations may be performed because sustain takes place during writing operations. When all writing operations have been completed, the positive signal, designated write switch, on the line 84 in FIG. 2A is removed, and the frequency of the SH drive signal and the frequency of the SV drive signal is changed back to the higher frequency for sustain operations which continue automatically thereafter. It is pointed out by way of interest that sustain operations may take place automatically without resetting the horizontal and vertical selection circuits. It was pointed out above that sustain operations are not affected by the state, selected or deselected, of the horizontal and vertical line drivers. Such is the case because after a writing operation is finished the waveforms on the busses 31 and 32 are identical, and the waveform of the output signal on the horizontal lines H1 through HN must be like that on the bus 31 or the bus 32. Likewise, the waveform on the bus 61 is identical to the waveform on the bus 62, and the waveforms on the vertical lines V1 through VN must follow the waveform of the signal on the bus 61 or the waveform of the signal on the bus 62.

Figure 5:
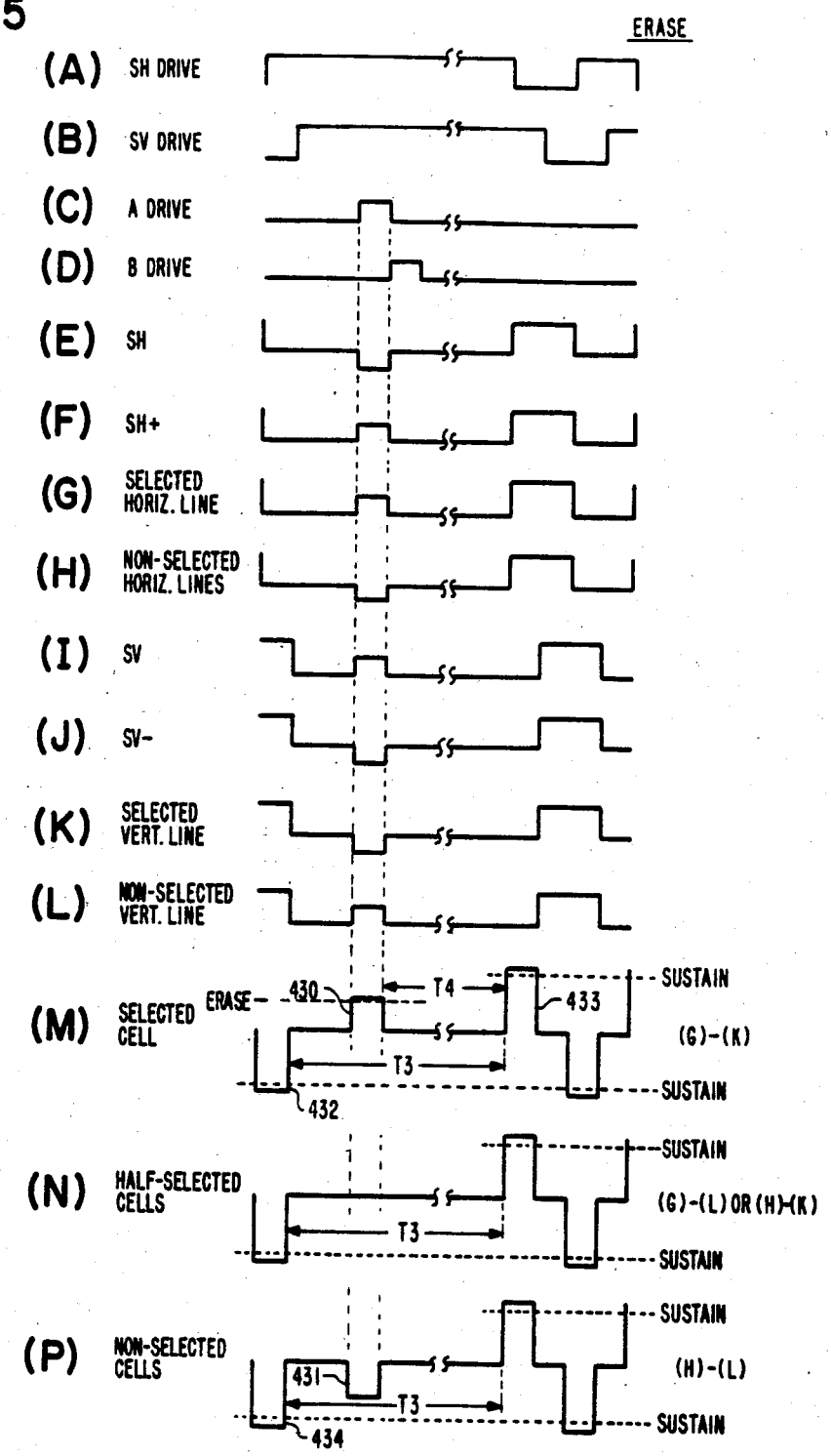
FIG. 5 shows waveforms which are helpful in explaining an erase operation.

An erase operation, used to extinguish a selected ignited gas cell on the gas panel 10 in FIG. 1 is described next. For an erase operation the horizontal selection circuit 25 in FIG. 1 selects one of the line drivers 21 through 24 and deselects the remaining ones of these line drivers. The vertical selection circuit 55 selects one of the line drivers 51 through 54 and deselects the remaining ones of these line drivers. FIG. 5 illustrates waveforms during an erase operation.

Whenever an erase operation takes place, the SH drive signal on the line 33 in FIG. 2A and the SV drive signal on the line 63 are latched up on their next positive excursions as shown in FIGS. 5A and 5B. A positive adjustable voltage, designated erase amplitude, is applied on the line 85 in FIG. 2A, and it controls the current source transistor 131. A positive signal, designated erase switch, is applied on the line 86, and consequently the transistors 132 and 131 become conductive.

Since the SH drive signal on the line 33 in FIG. 2A is latched up as shown in FIG. 5B, this causes the inverse or down signals to be supplied on the busses 31 and 32 for reasons previously explained. The inverse levels of the SH drive signal in FIG. 2A are shown in FIG. 5E and 5F. Since the SV signal on the line 63 in FIG. 2A is latched up, this causes an inverted or down level to be established on the busses 61 and 62 for reasons previously explained. The inverse levels of the SV drive signal in FIG. 2B are shown in FIGS. 5I and 5J.

A positive A drive pulse is applied to the line 81 in FIG. 2A, and this drives the transistor 101 into the conductive state. Current flows from the voltage source connected to the center tap of the primary winding 105 through the upper half of this primary winding, the transistor 101, the upper half of the resistor 109, the transistor 131, the resistor 135, and the transistor 132 to ground. A positive pulse is induced in the upper half of the windings 107 and 108 which are combined with sustain and supplied to the busses 31 and 61 in FIG. 2B in the manner previously explained. Negative pulses are induced in the lower half of the windings 107 and 108 which are combined with sustain and supplied to the busses 32 and 62 in FIG. 2B in the manner previously explained. The A drive signal is shown in FIG. 5C. The induced negative pulse on the bus 32 in FIG. 2B is shown in FIG. 5E, and the induced positive pulse on the bus 31 in FIG. 2B is shown in FIG. 5F. The induced positive pulse on the bus 61 in FIG. 2B is shown in FIG. 5I, and the induced negative pulse on the bus 62 in FIG. 2B is shown in FIGS. 5J.

The selected one of the horizontal line drivers 21 through 24 in FIG. 1 has its transistor driven into the non-conductive state by a select signal level on one of the lines 26 through 29, and the remaining ones of the horizontal line drivers 24 are driven into the conductive state by deselect signals on the remaining ones of the lines 26 through 29. If, for example, the horizontal line driver 21 in FIG. 2B is selected, the transistor 321 is driven off, and the signal on the selected horizontal line H1 follows the waveform of the signal on the bus 31 except for a slight voltage drop through the constant current diode 322. The waveform of the signal on the selected horizontal line H1 is shown in FIG. 5G. Since the horizontal line driver 24 in FIG. 2B is not selected, the transistor 321A is driven into the conductive state, and the waveform of the signal on the horizontal line NH follows the waveform of the signal on the bus 32. Likewise, the remaining non-selected horizontal lines H2 and H3 follow the waveform of the signal on the bus 32. Each of the non-selected horizontal lines has a signal with the waveform shown in FIG. 5H.

The vertical selection circuit 55 in FIG. 1 supplies a select signal level on one of the lines 56 through 59 which drives the transistor of the selected one of the line drivers 51 through 54 into the conductive state, and the remaining ones of the vertical line drivers 51 through 54 receive deselect signals on the associated ones of the lines 56 through 59 which drives their associated transistors into the non-conductive state. For example, if the line driver 51 in FIG. 2B is selected, the transistor 331 is driven into the conductive state, and the signal on the selected vertical line VI follows the signal on the bus 62. The waveform of the signal on the selected vertical line VI is shown in FIG. 5K. The waveform of the signal on each of the non-selected vertical lines V2 through VN is shown in FIG. 5L. For example, if the vertical line driver 54 in FIG. 2B is described, the transistor 331A is driven into the non-conductive state, and the signal on the line VN follows the signal on the bus 61 except for a slight voltage drop through the constant current diode 322A.

The selected gas cell on the panel 10 in FIG. 1 receives a potential difference having the waveform shown in FIG. 5M during an erase operation. A positive pulse 430 represents the potential difference applied across the selected gas cell as the result of the A drive pulse in FIG. 5C. The waveform in FIG. 5M is obtained by subtracting the waveform in FIG. 5K from the waveform in FIG. 5G. The waveform in FIG. 5N represents the potential difference applied across the half-selected cells, and this waveform is obtained by subtracting the waveform in FIG. 5L from the waveform in FIG. 5G or subtracting the waveform of FIG. 5K from the waveform of FIG. 5H. The A drive signal in FIG. 5C has no effect on the half-selected cells during an erase operation because the induced signals on the horizontal and vertical lines in question have a cancelling effect. The potential difference applied across the non-selected cells has the waveform shown in FIG. 5P, and this waveform results from subtracting the wave form in FIG. 5L from the waveform in FIG. 5H. The A drive signal causes a pulse 431 in FIG. 5P to be applied across the non-selected cells. This pulse, however, is uneventful as pointed out hereinafter.

The positive pulse 430 in FIG. 5M is applied across the selected gas cell as a result of the A drive pulse. The pulse 430 does not have sufficient amplitude to perform a sustain operation but it does have sufficient amplitude to perform an erase operation. The selected gas cell last was sustained by the negative pulse 432 in FIG. 5M. Since the positive pulse 430 drives the gas mixture of the selected gas cell with a signal of a polarity opposite to that of the last sustain pulse 432, the pulse 430 thereby produces a weak avalanche or plasma discharge and reduces the wall charge of the selected gas cell almost to zero. Upon expiration of the time T4 in FIG. 5M the selected gas cell has lost the remaining wall charge due to decay, and its discharge activity has subsided. Consequently, the selected gas cell remains dark or unlighted. The polarity of the pulse 430 should always be opposite to that of the last sustain pulse 432 when performing an erase operation. The time period T3 in FIG. 5N and FIG. 5P is a relatively long period, but it is not sufficiently long for the previously ignited cells to be reignited by the positive sustain pulses which arrive at the end of the time period T3. The pulse 431 in FIG. 5P is uneventful because the polarity of this pulse is the same as the polarity of the last sustain pulse 434, and the pulse 431 does not cause any avalanche and therefore does not change the cell history. The characteristic ability of the previously ignited non-selected cells to reignite in response to a sustain signal at the end of the time period T3 remains unchanged. Thus it is seen that the selected cell is extinguished by the end of the time period T4, and the remaining cells in the gas panel 10 are reignited at the end of the time period T3 if they were previously ignited.

It is pointed out that if all cells were absolutely uniform, the erase pulse would not have to be followed by a dead time since the erase pulse would have reduced the wall charge (or memory) to zero, but all cells are not uniform in a practical panel. Therefore, some residual wall charge, however small, still remains. The dead time then allows this residual wall charge to decay to zero. The erase operation thus is made uniform even with non uniform cells. The non selected cells will still retain enough wall charge (even though decay takes place therein also during dead time) to reignite after the dead time.

Upon termination of A drive pulse in FIG. 5C, the transistor 101 reverts to the non-conductive state, and a B drive pulse shown in FIG. 5D, is applied to the line 82 in FIG. 2A which drives the transistor 102 into the conductive state. Current flows from the voltage source connected to the center tap of the primary winding 105 through the lower half of this winding, the transistor 102, the lower half of the resistor 109, the transistor 131, resistor 135, and the transistor 132 to ground. The ferrite core 106 is reset. Signals induced into the secondary windings 107 and 108 are dissipated. as previously explained, without affecting the signals on the busses 31 and 32 or the busses 61 and 62. Positive signals on the line 86 in FIG. 2A are removed, and the erase operation is terminated. In FIG. 5 the erase operation terminates at the end of the time period T3, and waveforms shown in the right hand section perform sustain operations as previously explained.

The transistors 321, 321*a*, 331 and 331*a*, of the respective line drivers 21, 24, 51, and 54 have very low power requirements since their primary function is to superimpose an induced signal of relatively low power and voltage on the drive lines as the result of the A drive pulse supplied to the line 81 in FIG. 2A. Since the transistors in the line drivers of FIG. 2B have relatively low power requirements, the circuit components of the line drivers may be fabricated using integrated circuit techniques. The use of integrated circuits reduces the cost of construction particularly in devices of this type where the total number of horizontal and vertical lines may number in the thousands. The transistors in the sustain driver 30 and the sustain driver 60 in FIGS. 2A and 2B are of the high voltage, medium power type since they must handle the power requirements for the high voltage signals supplied to the busses 31, 32, 61 and 62. However, it is pointed out that the number of these transistors is small and fixed for any practical display system thereby minimizing the cost.

It is seen, therefore, that a novel method and apparatus for a gas panel display system are provided according to this invention. Variations in the shape of the applied SH drive and SV drive signals may be made. The constant current diodes in FIG. 2B may be replaced by collector resistors buffered by emitter follower transistors with diodes connected from base to emitter to assist negative transistions, or any other collector load configuration presenting a relatively low output impedance. The constant current diode was used to illustrate just one such law output impedance configuration.

While the invention has been particularly shown and described with reference to a preferred embodiment thereof, it will be understood by those skilled in the art that the foregoing and other changes in form and detail may be made therein without departing from the spirit and scope of the invention.

What is claimed is:

1. A method for writing and sustaining the gas cells of a gas panel which has a gas filled means with a plurality of horizontal lines disposed on one side and a plurality of vertical lines disposed on the opposite side, the vertical lines being orthogonal with respect to the horizontal lines, and the coordinate intersections of the horizontal lines and the vertical lines defining gas cells, the method including the steps of:

performing sustain operations by applying across all gas cells a potential difference in the form of a square wave train having positive and negative excursions each of which exceed the sustain level of the gas cells, and writing in a selected gas cell by decreasing the frequency of the square wave train and increasing the magnitude of the potential difference across a selected gas cell, and only the selected gas cell, above the ignition level of the gas.

2. The method of claim 1 including the further step of:

generating the square wave train of the potential difference for performing sustain operations by applying a first square wave train to the horizontal lines and a second square wave train to the vertical lines, the second square wave train being displaced 90° from the first square wave train.

3. The method of claim 2 including the further steps of:

generating the increased potential difference across the selected gas cells for a write operation by superimposing a pulse signal on a selected horizontal line which causes the potential on this line to swing in one direction and superimposing a pulse signal of like magnitude but of opposite polarity on the remaining horizontal lines, superimposing a pulse signal on a selected vertical line which changes the potential on the selected vertical line to swing in one direction and superimposing a pulse signal of like magnitude but of opposite polarity on the remaining vertical lines, and making the pulse signal superimposed on the selected horizontal line swing in a direction opposite to that of the pulse signal superimposed on the selected vertical line thereby to perform a write operation in the selected cell.

4. The method of performing sustain operations on all cells of a gas panel which includes a gas filled means with horizontal lines disposed on one side of the gas filled means and vertical lines disposed on the opposite side of the gas filled means which are orthogonal to the horizontal lines, the coordinate intersections of the horizontal and vertical lines defining gas cells, the method comprising the steps of:

applying a first square wave train to all horizontal lines, applying a second square wave train to all vertical lines which is displaced 90° from the first square wave train, whereby a potential difference is established across each gas cell in the form of a third square wave train each positive and negative excursion of which has an amplitude less than the ignition level but greater than the sustain level thereby to perform sustain operations on all gas cells on each positive and each negative excursion of the third square wave train.

5. The method of sustaining ignited cells in a gas panel which includes a gas filled means with horizontal lines disposed on one side and vertical lines being disposed orthogonally to the horizontal lines, the coordinate intersections of the horizontal and vertical lines defining gas cells, the method comprising the steps of:

applying a first undulating signal to all horizontal lines, and applying a second undulating signal displaced 90° from said first undulating signal to all of the vertical lines, thereby producing a third undulating signal corresponding to the algebraic sum of said first and second signals across each gas cell, said third undulating signal having a magnitude which is less than the ignition potential but greater than the sustain potential of the gas.

6. The method of claim 5 including the further step of making the frequency of the second undulating signal equal to the frequency of the first undulating signal.

7. The method of erasing ignited gas cells in a gas panel which includes a gas filled means having horizontal lines disposed on one side and vertical lines disposed on the other side, the vertical lines lying orthogonal to the horizontal lines, the coordinate intersections of the horizontal and vertical lines defining gas cells, the method comprising the steps of:

applying a first signal of constant amplitude to the horizontal and vertical lines, superimposing a second signal in the form of a pulse on said first signal, polarizing the second signal on a selected horizontal line different from the polarity of the second signal on the remaining horizontal lines, polarizing the second signal on a selected vertical line different from the polarity of the second signal on the remaining vertical lines whereby the polarity of the second signal on a selected vertical line is opposite to the polarity of the second signal on a selected horizontal line to thereby provide a potential difference across a selected gas cell which has a magnitude less than the sustain level but at least equal to the erase level of the selected gas cell and which has a polarity opposite to the polarity of the last sustain signal, and terminating said second signal and maintaining said first signal for a given period of time, whereby the selected gas cell is not reignited by a sustain potential difference subsequently applied thereacross.

8. A gas panel display device including:

first means filled with an illuminable gas, a plurality of horizontal lines disposed on one side of said first means, a plurality of vertical lines disposed on the opposite side of said first means, said vertical lines being disposed orthogonally to the horizontal lines with the coordinate intersections defining gas cells, second means connected to the horizontal lines for applying a first undulating signal to all horizontal lines, third means connected to the vertical lines for applying a second undulating signal to all vertical lines, said second undulating signal being displaced 90° from the first undulating signal, whereby said first undulating signal and said second undulating signal produce a third undulating signal across each gas cell the positive and negative excursions of which have a magnitude less than the ignition potential but greater than the sustain potential of each gas cell.

9. The apparatus of claim 8 wherein the frequency of the first undulating signal is equal to the frequency of the second undulating signal.

10. The apparatus of claim 8 further including:

fourth means coupled to the second and third means for reducing the frequency of the first and second undulating signals, fifth means coupled to the second and third means for superimposing a fourth signal on the first undulating signal applied to the horizontal lines and the second undulating signal applied to the vertical lines which produces a composite potential difference across each gas cell of a magnitude equal to the magnitude of the third undulating signal and which produces across the selected cell, and only the selected cell, a potential difference having an amplitude which exceeds the ignition potential of the illuminable gas, whereby a write operation takes place in the selected cell.

11. The apparatus of claim 10 wherein the fifth means supplies said third signal with a trailing edge which terminates coincident in time with the trailing edge of the undulating potential difference applied across the selected cell, whereby the write function is delayed until the sustain function is finished.

12. A display device including:

a gas panel consisting of an envelope filled with an illuminable gas, a first set of coordinate conductors disposed on one side of the gas panel and a second set of coordinate conductors, orthogonal to the first set of conductor, disposed on the other side of the gas panel, said first and second coordinate conductors defining gas cells in the region of each coordinate intersection, a first set of line drivers connected to the first set of coordinate conductors, a first bus and a second bus connected to the first set of line drivers, a first sustain driver connected to the first bus and second bus, a second set of line drivers connected to the second set of coordinate conductors, a third bus and a fourth bus connected to the second set of line drivers, a second sustain driver connected to the third bus and the fourth bus, first signal means connected to the first sustain driver for applying a first square wave signal to the first bus and the second bus, and second signal means connected to the second sustain driver for applying a second square wave signal to the third bus and the fourth bus, said second square wave being 90° behind the first square wave, said first set of line drivers supplying said first square wave signal to said first set of coordinate conductors, and said second set of line drivers supplying said second square wave signal to said second set of coordinate conductors, whereby the resulting potential difference applied across each gas cell is a square wave signal having an amplitude which is greater than the sustain voltage of each gas cell but is less than the ignition voltage of each gas cell.

13. The apparatus of claim 12 further including:

first selection means connected to the first set of line drivers for selecting any one of these line drivers, said selected one of the first set of line drivers supplying the signal on the first bus to the selected conductor of the first set of coordinate conductors and the remaining non-selected ones of the first set of line drivers supplying the signal on the second bus to the non-selected conductor of the first set of conductors, second selection means connected to the second set of line drivers for selecting any one of these line drivers, said selected one of the second set of line drivers supplying the signal on the fourth bus to the selected conductor of the second set of coordinate conductors and the remaining non-selected ones of the second set of line drivers supplying the signal on the third bus to the non-selected conductors of the second set of coordinate conductors, first means for supplying a control signal to said first sustain driver and said second sustain driver during a writing operation which drives the first bus, the selected line driver in said first set of line drivers, and the selected conductor in the first set of coordinate conductor in one direction and drives the fourth bus, the selected line driver in said second set of line drivers, and the selected conductor in said second set of coordinate conductors in the opposite direction thereby to increase the potential difference across the selected gas cell to a level above the sustain signal which is equal to or greater than the ignition potential, said control signal applied to said first sustain driver and said second sustain driver driving the second bus and the non-selected conductors of said first set of coordinator conductors in the same direction as the signal swing on the fourth bus and driving third bus and the non-selected conductors of said second set of coordinate conductors in the same direction as the signal swing on the first bus, whereby all gas cells receive a sustain signal level and the selected gas cell receives a write signal level which equals or exceeds the ignition signal level.

14. The apparatus of claim 13 wherein each line driver in said first set of line drivers includes a transistor and a constant current diode, the transistor having an emitter connected to the second bus, a collector connected through the constant current diode to the first bus, and a base connected to the first selection means.

15. The apparatus of claim 14 wherein the transistors are constructed of integrated circuits.

16. A gas display panel including:

an illuminable gas disposed in container means with horizontal and vertical drive lines adjacent to the container means defining gas cells at coordinate intersections, means to apply a signal of one polarity to a selected horizontal line, means to apply a signal of opposite polarity to a selected vertical line, means to apply to all non-selected horizontal lines signals equal in magnitude and polarity to the signal applied to the selected vertical line thereby to cancel the effect of the half-select signal on the non-selected cells on the selected vertical line, and means to apply to all non-selected vertical lines signals equal in magnitude and polarity to the signal applied to the selected horizontal line thereby to cancel the effect of the half-select signal on the non-selected cells on the selected horizontal line whereby a write operation may be performed in any selected gas cell, and only the selected gas cell, by a potential difference which exceeds the ignition potential of the gas.

17. A gas display panel including:

an illuminable gas disposed in container means with horizontal and vertical lines adjacent to the container means defining gas cells at coordinate intersections, means to apply a signal of one polarity to a selected horizontal line and a signal of opposite polarity to each non-selected horizontal lines, means to apply a signal to a selected vertical line which is opposite in polarity to the signal applied to the selected horizontal line, and means to apply to all non-selected vertical lines signals equal in magnitude and polarity to the signal applied to the selected horizontal line, whereby a write operation may be performed in any selected gas cell, and only the selected gas cell, by a potential difference equal to or greater than the ignition potential of the gas, and the effect of half select signals on the remaining gas cells on the selected horizontal line and the remaining gas cells on the selected vertical line are cancelled.

18. A method of writing in gas display panel which has an illuminable gas disposed in container means with horizontal and vertical drive lines adjacent to the container means defining gas cells at coordinate intersections, said method comprising the steps of:

applying a signal of one polarity to a selected horizontal line, applying a signal of opposite polarity to a selected vertical line, applying to all non-selected horizontal lines signals equal in magnitude and polarity to the signal applied to the selected vertical line thereby to cancel the effect of the half-select signal on the non-selected cells on the selected vertical line, and applying to all non-selected vertical lines signals equal in magnitude and polarity to the signal applied to the selected horizontal line thereby to cancel the effect of the half-select signal on the non-selected cells on the selected horizontal line, whereby the potential difference applied to the selected gas cell, and only the selected gas cell, exceeds the ignition potential of the gas.

19. The method of claim 18 wherein the steps are performed simultaneously.

20. The method of claim 19 wherein the applied signals include composite waveforms.

21. A method of extinguishing or erasing ignited gas cells in a gas panel which has an illuminable gas disposed in container means with horizontal and vertical lines adjacent to the container means defining gas cells at coordinate intersections, the method comprising the steps of:

1. applying a first signal of given magnitude and polarity to the horizontal and vertical lines,
2. superimposing a second signal on the first signal on a selected horizontal line which cause the signal on the selected horizontal line to swing in one direction,
3. superimposing a third signal on the first signal on a selected vertical line which causes the signal on the selected vertical line to swing in a direction opposite to that of the signal swing on the selected horizontal line,
4. superimposing a fourth signal on the first signal on the non selected horizontal lines which causes the signal on the non selected horizontal lines to swing in the same direction as the signal swing on the selected vertical line,
5. superimposing a fifth signal on the first signal on the non selected vertical lines which causes the signal on the non selected vertical lines to swing in the same direction as the signal swing on the selected horizontal line,
6. producing a signal difference across the selected gas cell only (1) which has a magnitude greater than the erase level thereby barely to ignite the selected cell but less than the sustain level of the selected gas cell and (2) which has a polarity opposite to that of the sustain level last applied to the selected cell, and 7. terminating the second, third, fourth, and fifth signals and maintaining said first signal for a given period of dead time thereafter thereby to permit any wall charge of the selected cell to decay to zero, whereby the selected gas cell is not reignited by a sustain signal difference subsequently applied thereacross and the extinguishing or erasing operation is effectively and uniformly performed throughout the gas panel even though all cells are not uniform.

22. The method of claim 21 further including the step of performing steps 1 through 6 simultaneously.

23. The method of claim 22 further including the step of making the second, third, fourth, and fifth signals substantially equal in magnitude.

24. A gas panel display device having an illuminable gas disposed in container means, horizontal and vertical lines adjacent to the container means defining gas cells at coordinate intersections, first means for applying a first signal of given magnitude and polarity to the horizontal and vertical lines, second means for superimposing a second signal on the first signal on a selected horizontal line which cause the signal on the selected horizontal line to swing in one direction, third means for superimposing a third signal on the first signal on a selected vertical line which causes the signal on the selected vertical line to swing in a direction opposite to that of the signal swing on the selected horizontal line, fourth means for superimposing a fourth signal on the first signal on the non selected horizontal lines which causes the signal on the non selected horizontal lines to swing in the same direction as the signal swing on the selected vertical line, fifth means for superimposing a fifth signal on the first signal on the non selected vertical lines which causes the signal on the non selected vertical lines to swing in the same direction as the signal swing on the selected horizontal line, whereby a signal difference is produced across the selected gas cell (1) which has a magnitude greater than the erase level which barely ignites the selected cell but less than the sustain level of the selected gas cell and (2) which has a polarity opposite to that of the sustain level last applied to the selected cell, and sixth means for terminating the second third, fourth, and fifth signals and maintaining said first signal for a given period of dead time thereafter thereby to permit any wall charge of the selected cell to decay to zero, whereby the selected gas cell is not reignited by a sustain signal difference subsequently applied thereacross and the extinguishing or erasing operation is effectively and uniformly performed throughout the gas panel even though all cells are not uniform in performance.

25. The apparatus of claim 24 wherein the second through the fifth means supply the respectively second through fifth signal with substantially equal magnitudes.

26. The apparatus of claim 24 wherein the second through the fifth means supply the respective second through fifth signals simultaneously.

27. A gas panel having:

an illuminable gas disposed in a container, horizontal and vertical lines disposed adjacent to but on opposite sides of the gas panel with the horizontal lines lying orthogonal to the vertical lines, erasing means coupled to the gas panel for extinguishing or erasing a selected ignited cell, the erasing means including:

first means to apply a first signal of one polarity to a selected horizontal line, second means to apply a second signal of opposite polarity to a selected vertical line, third means to apply a third signal having the same polarity of the first signal to all selected vertical lines thereby to cancel the effect of the half select signal in all cells on the selected horizontal line except the selected cell, fourth means to apply a fourth signal having the same polarity of the second signal to all non selected horizontal lines thereby to cancel the effect of the half select signal on all cells on the selected vertical line except the selected cell, whereby a signal difference is produced cross the selected gas cell which has (1) a less than the sustain level but magnitude greater than the erase level thereby barely to fire the selected cell and (2) a polarity opposite to that of the sustain level last applied to the selected cell, control means coupled to the first, second, third, and fourth means which terminates the first, second, third and fourth signals and delays for a given period of time the application of further signals thereby to allow any wall charge of the selected cell to decay to zero, whereby the selected gas cell is not reignitable by a sustain signal difference subsequently applied thereacross and the extinguishing or erasing operation is effectively and uniformly performed throughout the gas panel even though all cells are not uniform in performance.

28. The apparatus of claim 27 wherein the first through fourth means are operated simultaneously.

29. The apparatus of claim 27 wherein the first through fourth means supply the respective first through fourth signals with equal magnitudes.

30. In a process for operating a multiple gas discharge display/memory panel having opposed electrode arrays and at least one insulating dielectric charge storage member, the arrays being oriented so as to define a plurality of discharge cells, and wherein periodic rectangular sustaining voltages and writing voltage pulses are applied to the electrode arrays so as to operate the panel, the improvement wherein one of said writing voltage pulses is applied to one electrode of a discharge cell and a corresponding writing voltage pulse is applied to the opposing electrode of the cell, the two writing voltages being algebraically added across the cell from a near zero slope plateau so as to discharge the cell, the amplitude of the plateau varying as a function of said sustaining voltages, the magnitude of the writing voltage applied to either opposed electrode alone being insufficient to discharge any of said cells in the panel.

31. The invention of claim 30 wherein the amplitude of said plateau is equal to or less than the maximum amplitude achieved by the applied sustaining voltage in one period.

32. The invention of claim 31 wherein said two writing voltages are of substantially the same magnitude.

33. The invention of claim 31 wherein said two writing voltage pulses are algebraically added from a near zero slope plateau which is a part of said sustaining voltage.

34. In a process for operating a multiple gas discharge display/memory panel comprising an ionizable gaseous medium in a gas chamber formed by a pair of opposed dielectric material charge storage members backed by electrode members, the electrode members behind each dielectric material member being transversely oriented with respect to the electrode member behind the opposing dielectric material member so as to define a plurality of discharge cells, and wherein a periodic rectangular sustaining voltage is continuously applied to all of the cells of the panel and writing voltage pulses are applied to selected cells so as to discharge such cells, the improvement which comprises applying one writing voltage to one electrode of a discharge cell and applying a similar writing voltage to the opposing electrode of the cell such that the two writing voltages are algebraically added across the cell from a near zero slope plateau so as to discharge the cell, the amplitude of said plateau being equal to or less than the maximum amplitude achieved by and varying as a function of the applied sustaining voltage in one period, the magnitude of each of said writing voltages being equal to or less than the maximum amplitude achieved by the total applied sustaining voltage in one period.

35. The invention of claim 34 wherein at least one of said two writing voltage pulses has a rectangular waveform.

36. A method of manipulating the discharge condition of a gas discharge information storage panel device having transversely oriented dielectrically insulated conductors or opposite sides of a thin gaseous discharge medium which comprises applying a periodically alternating pulse potential across said gas by applying in time relation a first sequence of rectangular signals to the conductors oriented in a first direction and a second sequence of rectangular signals to conductors oriented in a second direction transverse relative to the direction of said conductors oriented in said first direction, the amplitude of said pulse potentials in said first and second sequence being of substantially the same magnitude, and modulating at least one electrical parameter of at least one of said rectangular signals in said sequence as applied to the conductors oriented in one of said directions.

37. The invention defined in claim 36 wherein said electrical parameter that is modulated is the amplitude of said rectangular signal.

38. The invention defined in claim 36 wherein said electrical parameter that is modulated is the time duration width of said rectangular signal.

39. A method for writing and sustaining the gas cells of a gas panel which has a gas filled means with a plurality of horizontal lines disposed on one side and a plurality of vertical lines disposed on opposite sides thereof, said vertical lines being substantially orthogonal with respect to said horizontal lines, and the coordinate intersections of said horizontal lines and said vertical lines defining gas cells, the method including the steps of:

performing sustain operations by applying across all gas cells a potential difference in the form of a train of rectangular signals having positive and negative excursions each of which exceed the sustain level of the gas cells, and writing in a selected gas cell by increasing the magnitude of the rectangular write voltage signals of selected gas cells above the discharge potential of the gas, the polarity of said write voltage signals corresponding to the polarity of the preceding rectangular sustain signal.

40. The method of claim 39 wherein said write voltage signals are algebraically added to the near zero slope plateau of the sequentially related rectangular sustain signal.

41. The method of claim 40 wherein the write voltage signal is algebraically added beyond the leading edge of the associated rectangular sustain signal to maintain a time differential between the sustain and write operations.

42. The method of claim 40 wherein said write signal is algebraically added to the trailing edge of the sequentially related rectangular sustain signal to provide time for the gas cells to complete the sustain operation prior to initiating a write operation.

43. In a process for operating a multiple gas discharge display/memory panel having opposed electrode arrays and at least one insulating dielectric charge member, the arrays being oriented so as to define a plurality of gas cells, and wherein sustain signals comprising a first and second sequence of rectangular signals which, when combined, exceed the sustain level of said gas cells, are applied to the opposing electrodes of all of said plurality of gas cells and write signals are selectivity applied to selected gas cells, said write signals comprising at least one rectangular voltage pulse which when algebraically added to said sustain signal sequences exceeds the discharge potential of said gas at selected gas cells, the improvement wherein the polarity of each of said write pulses corresponds to the polarity of the immediate preceding sustain signal.

44. The method of claim 43 wherein said write signals are generated by algebraically adding said rectangular write pulses to said rectangular sustain signals from a near zero slope plateau portion of said sustain signal waveform to generate a potential difference across said selected cells which exceeds the discharge potential of said selected cells.

45. The method of claim 43 wherein said write signal is generated beyond the leading edge of the near zero plateau portion of said associated sustain signal waveform with which it is algebraically added whereby the sustain and write functions take place at different time intervals.

46. The method of claim 44 wherein said square wave write pulses are of shorter duraction than said sustain signal and generated at the trailing edge of the near zero plateau portion of said associated sustain signal to maintain a time separation between said sustain and write operations.

47. A method of manipulating the discharge condition of a gas discharge information storage panel device having transversely oriented dielectrically insulated conductors on opposite sides of a thin gaseous discharge medium which comprises applying a periodically alternating pulse potential across said gas by applying, in selectively timed relation, a first sequence of electrical pulses to the conductors oriented in a first direction and a second direction transverse relative to the direction of said conductors oriented in said first direction whereby the gaseous medium between said conductors has said periodically alternating pulse potential applied thereto, and constitutes a sustaining potential for discharges at any site in said panel device and modulating at least one electrical parameter of at least one pulse of a sequence as applied to the conductors oriented in one of said directions, said electrical modulated parameter being the time duration width of said electrical pulse.

48. The invention defined in claim 47 wherein a second of the electrical parameters that is modulated is the amplitude of said electrical pulses.

49. The invention defined in claim 47 wherein the pulse width is widened so as to store information at a selected discharge site, said selected site being located at the cross over point of a selected pair of transverse conductors.

50. In a system for manipulating and sustaining discrete discharge sites of a gas discharge display panel wherein periodically alternating pulses are continually applied to all conductors in row-column conductor arrays of said panel, said conductors being insulated from the gas, improvement in the means for manipulating the discharge condition of discharge sites located by selected ones of said row and column conductors, respectively, comprising means for modulating the time duration of at least one of said periodically alternating pulses to thereby alter the charge stored at said selected site.

51. The invention defined in claim 50 wherein said means for modulating includes at least one conductor multiplex selection circuit for selecting individual ones of said conductors respectively and modulating the time duration of pulse voltages applied thereto.

52. The invention defined in claim 51 wherein said multiplex selection circuit includes means for adding a voltage increase to the pulse whose time duration is modulated.

53. The invention defined in claim 51 wherein there is at least one multiplex selection circuit for the row conductors and at least one for the column conductors.

54. The invention defined in claim 53 wherein each selection circuit includes means for adding a voltage increase to the pulse whose time duration is modulated to aid in writing on said panel.

55. A method of manipulating the discharge condition of a gas discharge information storage panel device having a first array of dielectrically insulated electrodes transversely oriented with respect to a second array of dielectrically insulated electrodes, both of said arrays being proximate to gaseous discharge medium which comprises applying a periodically alternating pulse potential between electrodes of the first and second arrays through the gaseous discharge medium by applying a pulsating bulk sustainer voltage to the first array; selectively applying first voltage pulses referenced to the bulk sustainer voltage to electrodes of the first array; and selectively applying second voltage pulses referenced to a fixed voltage to electrodes of the second array.

56. A method according to claim 55 wherein the fixed voltage level is ground.

57. A method according to claim 55 including applying said second voltage pulses in timed relation to the applied pulsating bulk sustainer voltage.

58. A method according to claim 55 including modulating the time duration width of the pulses of the pulsating bulk sustainer according to the discharge condition manipulation to be achieved.

59. A method according to claim 55 including modulating the amplitude of the pulsating bulk sustainer according to the discharge condition manipulation to be achieved.

60. A method according to claim 59 including modulating the time duration width of the pulses of the pulsating bulk sustainer according to the discharge condition manipulation to be achieved.

61. A method according to claim 58 including applying said second voltage pulses in timed relation to the applied pulsating bulk sustainer voltage.

62. A method according to claim 59 including applying said second voltage pulses in timed relation to the applied pulsating bulk sustainer voltage.

63. A method according to claim 55 wherein said second voltage pulses are applied simultaneously to a plurality of electrodes of said second array in a predetermined time relation to said bulk sustainer voltage and said selective application of said second voltage pulses defines a time interval at the fixed voltage coincident with said application of said first voltage pulses.

64. A method according to claim 63 wherein said selective application of pulses is applied to selected electrodes of said second array.

65. A method according to claim 55 wherein proximate portions of electrodes of the first and second arrays each define a discharge site in the gaseous discharge medium and wherein the dielectric separating the proximate portions from the gaseous discharge medium assumes a given neutral wall voltage when the site is in a non discharging state while the periodically alternating pulse potential is applied between electrodes of the first and second arrays, including the step applying the voltage of the pulsating bulk sustainer which imposes on the first array lower voltages which are less than the maximum voltage deviation of the bulk sustainer from the neutral wall voltage for a preponderance of the period of the alternating pulse potential between electrodes of the first and second arrays to condition the device for termination of a discharge at a site which is in a discharging state.

66. A method according to claim 65 wherein said lower voltages include a low voltage for a first portion of the preponderance of the period and a voltage intermediate the low voltage and the maximum voltage for a terminal portion of the preponderance of the period.

67. A method according to claim 65 including the step of applying the second voltage pulse in overlapping time relationship with an initial portion of the application of the lower voltages.

68. A method according to claim 65 including the step of applying the first voltage pulse associated with the electrode of a site which is in an "on" state of discharge during application of the lower voltages by the bulk sustainer to impose a voltage sufficient to initiate a discharge to an "off" state of discharge at the selected site.

69. A method according to claim 66 including the step of applying the first voltage pulse associated with the electrode of a site which is in an "on" state of discharge during application of the intermediate voltage by the bulk sustainer to impose a voltage sufficient to initiate a discharge to an "off" state of discharge at the selected site.

70. A method according to claim 66 including the step of applying a voltage transition toward the reference level as the second voltage pulse associated with the electrode of a site which is in an "on" state of discharge during application of the lower voltage by the bulk sustainer to impose a voltage sufficient to initiate a discharge to an "off" state of discharge at the selected site.

71. A method according to claim 55 wherein the step of selectively applying second voltage pulses includes a transition of voltage toward the fixed voltage in time coincidence with the step of selectively applying first voltage pulses.

72. A method according to claim 71 wherein the fixed voltage level is ground.

73. A system for manipulating the discharge condition of a gas discharge information storage panel device having a first array of dielectrically insulated electrodes transversily oriented with respect to a second array of dielectrically insulated electrodes, both of said arrays being proximate to a gaseous discharge medium which comprises a source of a periodically pulsating bulk sustainer voltage; means for applying said bulk sustainer voltage to said first array of electrodes; first drivers for first select pulse voltages referenced to said bulk sustainer voltage and coupled to each of said first electrodes, first selective actuating means for selectively actuating said first drivers to apply said first pulse voltages to selected electrodes of said first array; second drivers for pulse voltages referenced to a fixed voltage and coupled to each of said electrodes of said second array; and second selective actuating means for selectively actuating said second drivers.

74. A system according to claim 73 wherein said fixed voltage is ground and said means for selectively actuating said second drivers is referenced to ground.

75. A system according to claim 73 including means to define a plurality of types of discharge condition manipulations; logic circuitry to selectively control the means for applying said bulk sustainer to apply voltage excursions of said bulk sustainer voltage on a time duration basis as a function of the type of discharge condition manipulation defined by said defining means; said logic circuitry including means to control said selectively actuating means for said first drivers and said selectively actuating means for said second drivers.

76. A system according to claim 73 including means to actuate said second drivers to impose a voltage excursion from said fixed voltage on a plurality of said electrodes of said second array; and wherein said second selective actuating means for said second drivers cause a voltage excursion toward said fixed voltage on a selected electrode of said plurality in coincidence with the selective actuation of by said first selective actuating means of a first driver.

77. In an operating system for a gas discharge display/memory cell defined by proximate electrode portions of a pair of opposed spaced electrodes; an ionizable gas volume between the spaced electrode portions of the cell; a dielectric charge storage member in contact with the gas insulating at least one electrode portion of the cell from the gas; a sustainer voltage source for cyclically imposing a pulsating voltage having a period and a predetermined maximum potential referenced from a ground potential across the cell; and an addressing means for generating address voltage pulses to manipulate the discharge state of the cell between an "on state" and an "off state", the improvement comprising:

means for generating write and erase address voltage pulses included in the addressing means, said write pulse referenced from the ground potential for changing the cell from the "off state" to the "on state" and said erase pulse referenced from the ground potential for changing the cell from the "on state" to the "off state"; and switching means connected between the addressing means and the pair of opposed spaced electrodes for applying said write and erase pulses to the cell.

78. A system according to claim 77 wherein said address voltage pulse generating means generates said write pulse with a first predetermined magnitude and generates said erase pulse with a second predetermined magnitude.

79. In an operating system for a multicelled gas discharge display/memory device, the device including a pair of opposed spaced electrode arrays with proximate electrode portions of at least one electrode in each array defining the cells; an ionizable gas volume between the spaced electrode portions of each cell; a dielectric charge storage member in contact with the gas insulating at least one electrode portion of each cell from the gas; a sustainer voltage source for cyclically imposing a pulsating voltage having a period and a predetermined maximum potential referenced from a ground potential across each of the cells; and an addressing means for generating address voltage pulses to manipulate the discharge state of individual selected cells between an "on state" and an "off state", the improvement comprising:

means for generating write and erase address voltage pulses included in the addressing means, said write pulse referenced from the ground potential for changing the selected cells from the "off state" to the "on state" and said erase pulse referenced from the ground potential for changing the selected cells from the "on state" to the "off state"; and switching means comprising a plurality of switches each connected between said addressing means and one of the electrodes of said pair of electrode arrays.

80. A system according to claim 79 wherein said address voltage pulse generating means generates said write pulse with a first predetermined magnitude and generates said erase pulse with a second predetermined magnitude.

81. A system according to claim 79 wherein said address voltage pulse generating means includes a first pulser means connected to one of the electrode arrays for generating a first partial select voltage pulse and a second pulser means connected to the other electrode array to generate a second partial select voltage pulse to form said address voltage pulses.

82. A system according to claim 81 wherein said first pulser means includes a write pulser means for generating a write partial select voltage pulse wherein said write partial select voltage pulse and said second partial select voltage pulse form said write pulse and includes an erase pulser means for generating an erase partial select voltage pulse wherein said erase partial select voltage pulse and said second partial select voltage pulse form said erase pulse.

* * * * *